US007104234B2

(12) United States Patent
Suzuki et al.

(10) Patent No.: US 7,104,234 B2
(45) Date of Patent: Sep. 12, 2006

(54) ENGINE GROUND SYSTEM

(75) Inventors: Jun Suzuki, Tokyo (JP); Akira Sato, Machida (JP)

(73) Assignee: Sun Automobile Corporation, Tokyo (JP)

( * ) Notice: Subject to any disclaimer, the term of this patent is extended or adjusted under 35 U.S.C. 154(b) by 0 days.

(21) Appl. No.: 10/521,471

(22) PCT Filed: Oct. 10, 2002

(86) PCT No.: PCT/JP02/10564

§ 371 (c)(1),
(2), (4) Date: Apr. 4, 2005

(87) PCT Pub. No.: WO2004/007952

PCT Pub. Date: Jan. 22, 2004

(65) Prior Publication Data

US 2005/0166882 A1 Aug. 4, 2005

(30) Foreign Application Priority Data

Jul. 16, 2002 (JP) ..... 2002-207624

(51) Int. Cl.
*F02P 15/00* (2006.01)
*F02F 7/00* (2006.01)

(52) U.S. Cl. ..... 123/143 C; 123/169 PA; 123/633; 439/125

(58) Field of Classification Search ..... 123/143 C, 123/169 PA, 169 R, 633, 635; 439/125; 307/9.1

See application file for complete search history.

(56) References Cited

U.S. PATENT DOCUMENTS 5,180,313 A * 1/1993 Brandt ..... 439/125

FOREIGN PATENT DOCUMENTS

| | | |
|---|---|---|
| JP | 9-32713 | 2/1997 |
| JP | 2002-303205 | 10/2002 |

* cited by examiner

*Primary Examiner*—T. M. Argenbright
(74) *Attorney, Agent, or Firm*—Jordan and Hamburg LLP

(57) ABSTRACT

An engine ground system for increasing the potential of an engine. This is an engine ground system wherein intermediate portions of a ground wire one end of which is electrically connected to the negative electrode terminal of a battery are electrically connected to engine ground points and the other end of the ground wire is grounded to the car body. The engine ground points can be an engine cylinder head, an intake manifold clamping member, a cylinder head cover, and a throttle body (7*b*). Further, a plug cap ground wire is connected between the plug cap clamping member and the intake manifold clamping member.

9 Claims, 23 Drawing Sheets

LUMINOSITY MEASUREMENT RESULTS (h c d)

| | VEHICLE A (AIR CONDITIONER IS OFF) | VEHICLE A (AIR CONDITIONER IS ON) | VEHICLE B (AIR CONDITIONER IS OFF) |
|---|---|---|---|
| BEFORE GROUND MOUNTING | 59800 | 53400 | 52600 |
| AFTER GROUND MOUNTING | 61800 | 59000 | 53900 |

| TEST RESULTS / MEASUREMENT CONDITIONS | | MAXIMUM TORQUE (kg-m) | MAXIMUM OUTPUT (PS) |
|---|---|---|---|
| GROUND SYSTEM IS NOT MOUNTED | | T1 = 26.97 | P1 = 229.3 |
| GROUNDED SYSTEM IS MOUNTED | THROTTLE BODY IS NOT GROUNDED | T2 = 27.01 | P2 = 233.7 |
| | THROTTLE BODY IS MOUNTED | T3 = 27.82 | P3 = 236.6 |

FIG.23

ENGINE GROUND SYSTEM

BACKGROUND OF THE INVENTION

The present invention relates to an engine ground system, for example, to an engine ground system that decreases the electric resistance, smooths the flow of electric current, and improves performance characteristics of the engine by directly grounding the ground points of the automotive engine carrying a direct ignition coil of an internal igniter type to a negative electrode terminal of a battery via a ground wire.

A variety of measures have been taken to improve output performance of engines installed on automobiles. For example, a spark tuning system was disclosed in which a mixture inside the combustion chamber of the engine was brought closer to a complete combustion state by connecting the spark plugs by a wire harness having a specific structure and conducting spark tuning of the spark plugs. The applicant has also employed such a spark tuning system in practice. With this technology, engine output is increased by conducting optimum control of the electric current value inputted to the positive electrode terminal side of the spark plug in a state prior to spark plug discharge. On the other hand, the development of a ground system for controlling the minus electric current after a spark plug discharge, that is, after the spark plugs have been activated, is also required.

In the conventional ground system for automobiles, the electric current of a power source is supplied from the positive electrode terminal of a battery to a variety of electric devices such as electronic control devices carried by the automobile, spark plugs, stator motor, instruments on an instrument panel, illumination devices such as lamps, and acoustic devices. Further, after flowing through the electric devices, the electric current flowed through a ground wire connected to the vehicle body and returned to the negative terminal of the battery. As a result, wiring of the wire hardness for electrically connecting various electric devices and the battery was simplified. However, vehicle bodies are usually formed by using steel sheets. Therefore, the conductivity thereof is about one tenth that of copper used for the wire harness, and when the vehicle body is employed for grounding, electric resistance is high. As a result, there is an adverse effect on the spark system of the engine and the engine is greatly hindered from exhibiting its full potential. Another problem is that when the intake flow passes inside the throttle device of an engine intake system, intake air friction causes static electricity, which creates noise hindrance for signal wires of acoustic devices wired in the engine compartment.

Accordingly, the applicant has conducted research and development of an engine ground system for improving the output characteristics of an engine based on the knowledge obtained with the spark plug tuning system that has been heretofore disclosed. As a result, new technology bringing out an engine's full potential has been created.

Thus, with the foregoing in view, it is an object of the present invention to provide an engine ground system that increases an engine's potential by causing the minus electric current after the spark plug discharge to flow smoothly to the ground wire using a constitution wherein the intermediate positions on the ground wire wired between the negative electrode terminal of the battery and the vehicle body are connected to a cylinder head, which is the ground point of the engine, or to a plug cap of a direct ignition coil via this cylinder head.

SUMMARY OF THE INVENTION

The inventors have created the following inventions to resolve the above-described problems.

Thus, the invention of claim 1 relates to an engine ground system in which intermediate positions on a ground wire electrically connected by one end thereof to a negative electrode terminal of a battery are electrically connected to ground points of the engine and then the other end of the ground wire is grounded to the vehicle body, wherein the ground point of the engine is set on the cylinder head of the engine.

When the above-described configuration is employed, the minus current on the negative electrode side during a spark in a spark plug smoothly flows to the negative electrode terminal via the ground wire from the ground point provided on the cylinder head. As a result, the electromotive force induced in the ignition coil on the secondary side is increased and spark performance is greatly improved.

Another aspect of the invention relates to an engine ground system in which intermediate positions on a ground wire electrically connected by one end thereof to a negative electrode terminal of a battery are electrically connected to ground points of the engine and then the other end portion of said ground wire is grounded to the vehicle body, wherein the ground points of the engine are the cylinder head of the engine and a clamping member for an intake manifold for clamping the intake manifold to the cylinder head.

With such a configuration, an additional effect is that the minus current of the spark plug also flows from the clamping member for the intake manifold to the negative electrode terminal of the battery via the ground wire and spark characteristics are further improved.

Another aspect of the invention relates to an engine ground system in which intermediate positions on a ground wire electrically connected by one end thereof to a negative electrode terminal of a battery are electrically connected to ground points of the engine and then the other end of the ground wire is grounded to the vehicle body, wherein the ground points of the engine are the cylinder head of the engine, a clamping member for an intake manifold for clamping the intake manifold to the cylinder head, and a cylinder head cover.

With such a configuration, an additional effect is that the minus current of the spark plug also flows from the cylinder head cover, thereby accordingly improving the accuracy of ground tuning.

Another aspect of the invention relates to an engine ground system in which intermediate positions on a ground wire electrically connected by one end thereof to a negative electrode terminal of a battery are electrically connected to ground points of the engine and then the other end portion of said ground wire is grounded to the vehicle body, wherein the ground points of said engine are the cylinder head of the engine and a clamping member for an intake manifold for clamping the intake manifold to the cylinder head, a cylinder head cover, and a throttle body.

With such a configuration, because the throttle body is also made a ground point, static electricity generated on the throttle body can be removed. As a result, a smooth flow of minus electric current of the spark plugs to the negative electrode terminal of the battery can be implemented, the spark performance of the spark plugs is further improved, and the hindrance of acoustic devices by noise induced by static electricity can be avoided.

According to another aspect of the invention, spark means provided in the engine has a direct ignition coil of an internal igniter type and the other end of the ground wire for a plug cap electrically connected by one end thereof to the plug cap accommodating the direct ignition coil is electrically connected to the clamping member for an intake manifold.

With such a configuration, the ground wire for the plug cap is provided so as to connect the plug cap accommodating the direct injection coil and the clamping member for the intake manifold. Therefore, the minus electric current of the spark plug flows directly from the plug cap to the ground wire for the plug cap, the electric resistance toward the negative electrode terminal of the battery is accordingly decreased, and the spark performance of the spark plug is improved.

Another aspect of the invention relates to the engine ground system described immediately hereinabove, wherein the one end of the ground wire for a plug cap is connected to the clamping member for the plug cap for clamping the plug cap to the cylinder head.

According to another aspect of the invention, one end of the ground wire for a plug cap is connected to the clamping member for the plug cap which is screwed into the cylinder head of the engine. Therefore, the minus current of the spark plug flows to the ground wire for the plug cap with higher reliability.

According to another aspect of the invention, a negative electrode terminal of the battery to which the other end of the ground wire is electrically connected is grounded to the vehicle body via another ground wire different from the aforementioned ground wire.

With such a configuration, in addition to the ground wire, a separate ground wire is electrically connected to the negative electrode terminal of the battery. Therefore, the wiring of the ground wire is simplified.

According to another aspect of the invention, the ground wire and the ground wire for a plug cap have a four-layer structure comprising, from the core portion thereof, a core wire composed of bundled twisted wires formed by twisting fine copper wires, an inner coating member, which is a synthetic resin material coated on the outer periphery of the core wire, a wire mesh, which is an electrically conductive material provided so as to cover the outer periphery of the coating material, and an outer coating member, which is a synthetic resin material provided on the outer periphery of the wire mesh.

With such configuration, the core wire of the ground wire or the ground wire for a plug cap having a four-layer structure is formed from a copper material and demonstrates an ultra-low resistance. As a result, the minus current generated in the spark plugs can smoothly flow to the negative electrode terminal of the battery. Furthermore, because the core wire is covered with the wire mesh, electromagnetic waves emitted from the engine compartment to the outside environment can be reliability shielded, and noise generated in the electronic control equipment for the engine and hindrance such as noise in the audio equipment can be effectively avoided.

BRIEF DESCRIPTION OF THE DRAWINGS

FIG. 23 is a table showing the maximum torque values and maximum output values of FIGS. 17 to 22.

DETAILED DESCRIPTION OF THE INVENTION

Figure 1:
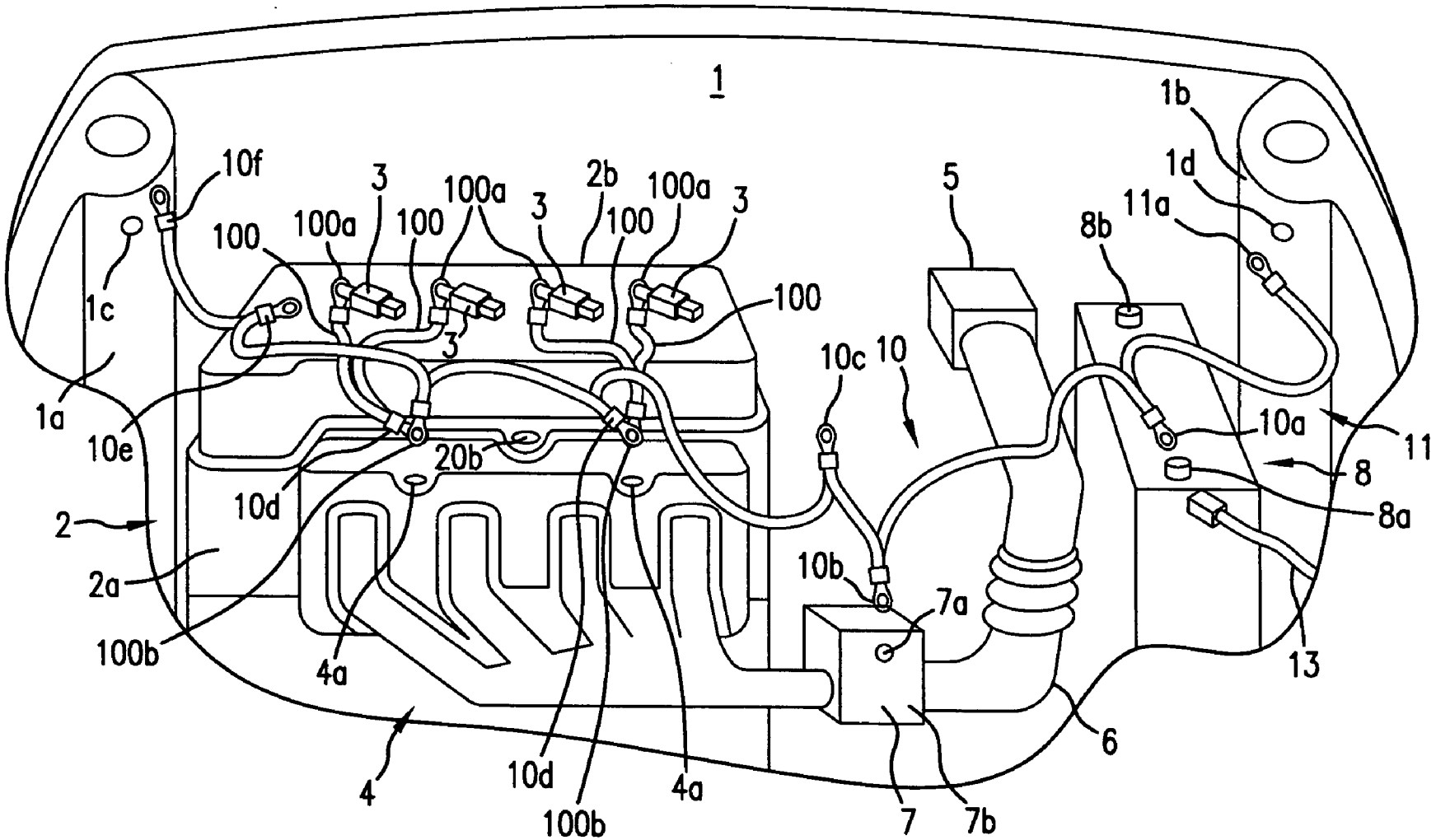
FIG. 1 is an external perspective view showing the inside of the engine compartment of an embodiment of the present invention.
Figure 2:
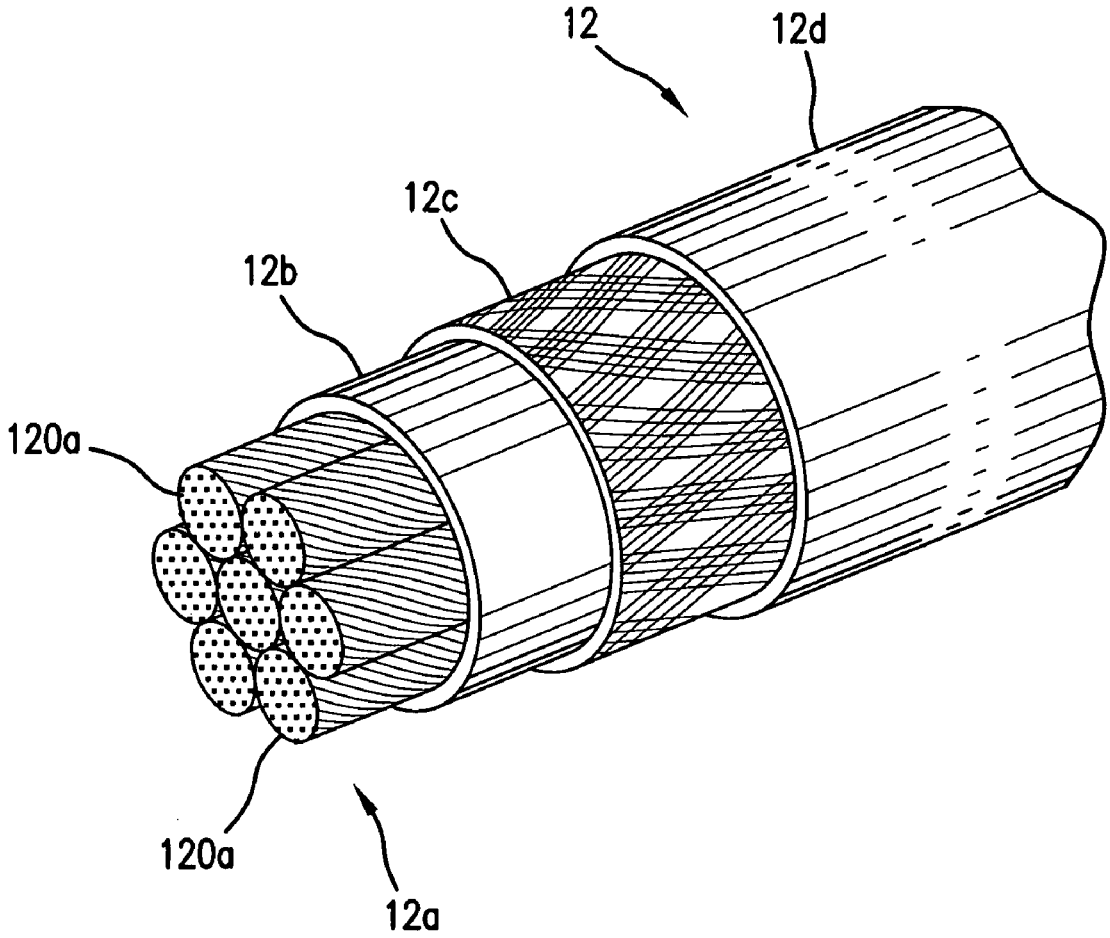
FIG. 2 is an external perspective view showing the cross-sectional structure of a wire harness.
Figure 3:
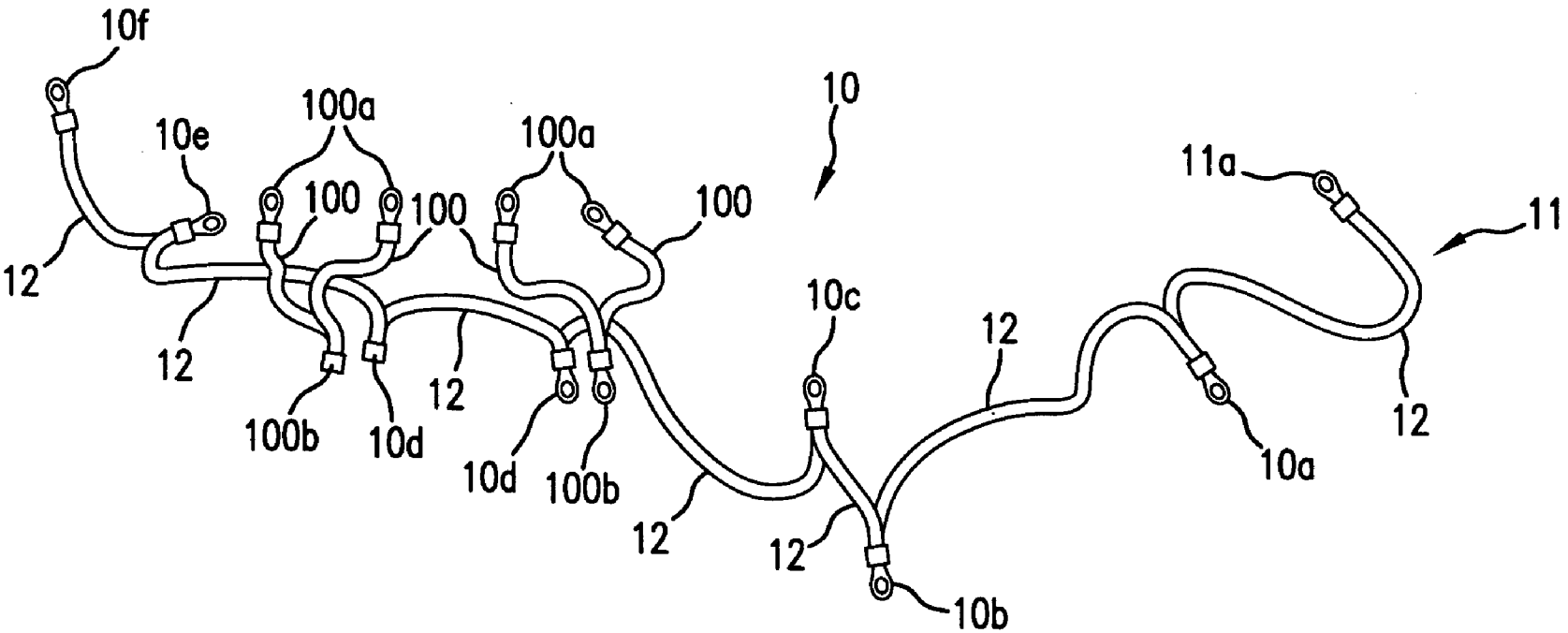
FIG. 3 is an external perspective view showing the first ground wire, second ground wire, and ground wire for a plug cap constituting the ground system of the engine shown in FIG. 1.

The embodiments of the present invention will be described in detail hereinbelow with reference to FIG. 1 through FIG. 3. FIG. 1 is a perspective external view of an engine compartment 1, as seen by a person standing on the front bumper looking down at the engine compartment 1 of a car of the present embodiment. As shown in FIG. 1, an engine 2 transversely disposed in the engine compartment 1 is, for example, a four-cylinder ignition engine. In a cylinder head 2*a* thereof, a cavity accommodating a spark plug is formed in each cylinder. The spark plugs are accommodated and fixed by screwing into the cylinder head 2*a*. Further, a plug cap 3 accommodating an internal igniter type direct ignition coil is detachably provided on the positive electrode terminal of the head portion of each spark plug facing outwardly from the spark plug fixed to the cylinder head cover 2*b*. This direct ignition coil represents an ignition system that does not use a plug cord, prevents the current loss or noise arising when a plug cord is used, and directly provides a secondary current to the ignition plug by a primary current of the igniter. Therefore, the ignition timing, for example, can be obtained by detection with a crank sensor of the engine, computer processing in combination with information from a fuel injection device, and electronic control.

Furthermore, an intake manifold 4 is clamped and fixed to the side surface of the cylinder head 2*a* with a bolt 4*a* which is a clamping member for the intake manifold. Each cylinder (not shown in the figure) is so formed that external air taken into an air cleaner 5 passes through a suction duct 6 and throttle device 7 and is then supplied from the intake manifold 4.

A first ground wire 10 and a second ground wire 11 (separate ground wire), which are electrically connected respectively to a left strut tower (automobile body, may be a fender panel or inner liner) 1*a* and a right strut tower (automobile body, may be a fender panel or inner liner) 1*b* forming the engine compartment 1, are electrically connected to a negative electrode terminal 8*a* of a battery 8. Such a wiring provides for grounding to both the first ground wire 10 and second ground wire 11, as well as the negative electrode terminal 8*a* of the battery 8 and left and right strut towers 1*a*, 1*b*.

The structure of a wire harness 12 used for the above-described first ground wire 10, second ground wire 11 and the below described ground wire 100 for a plug cap will be described hereinbelow with reference to FIG. 2. The wire harness 12 used for the ground system of the engine of the present embodiment has a four-layer structure in which a core wire 12*a* of the central portion is formed by seven twisted wires 120*a*. Each twisted wire 120*a* is obtained, for example by twisting a bundle of 211 copper wires with a diameter of 0.12 Ø and a high purity (99.9%), thereby ensuring a high electric conductivity. The surface of the copper wires is subjected to oxidation-preventing treatment to protect from corrosion. The core wire 12*a* is covered on the outside with an inner coating member 12*b* which is a synthetic resin material, for example, polyvinyl chloride or a polyolefin, to reduce noise and ensure strength. The outer periphery of the inner coating member 12*b* is covered with a wire mesh 12*c* from an electrically conductive material, for example, brass, as a shield for preventing electromagnetic waves from leaking to the outside. An outer coating member 12*d*, which is a synthetic resin material with high heat resistance and bendability, is covered on the outer periphery of the wire mesh 12*c*. The wire harness 12 thus has as a whole a four-layer structure, and a cable 12 (wire harness) with greatly reduced electric resistance is thus formed.

The structure of the first ground wire 10 and second ground wire 11 used in the ground system of the engine will be explained below with reference to FIG. 1 through FIG. 3. The first ground wire 10 and second ground wire 11 use the above-described wire harness 12 and are crimped together with battery metal terminals 10*a* connected to the negative electrode terminal 8*a* of the battery 8, thereby forming continuous ground wires. In addition to the aforementioned battery metal terminal 10*a*, crimped to the first ground wire are a throttle metal terminal 10*b* for connection to the throttle body 7*b* of the throttle device 7, a cylinder head metal terminal 10*c* for connection to the cylinder head 2*a*, an intake manifold metal terminal 10*d* (two in the present embodiment) for connection to the clamping member 4*a* for the intake manifold, a cylinder head cover metal terminal 10*e* for connection to the cylinder head cover 2*b*, and a strut metal terminal 10*f* for connection to the left strut tower 1*a*. The wire harnesses 12 are integrally and continuously connected in those terminals 10*b*–10*e*. Further, the second ground wire 11 joined by integrally crimping in the battery metal terminal 10*a* is joined at the free end thereof by crimping the strut metal terminal 11*a* connected to the right strut tower 1*b*.

Further, four ground wires 100 for plug caps are provided in the first ground wire 10. Each ground wire 100 for a plug cap has attached by crimping to one end thereof a plug cap metal terminal 100*a* for electric connection to each plug cap 3, and to the other end thereof a manifold metal terminal 100*b* for electric connection to the bolt 4*a* which is an intake manifold clamping member. Thus, each two adjacent ground wires 100 for plug caps form a pair and are integrally crimped and connected when crimped with the manifold metal terminal 100*b* and are formed so as to fork into two branches from the manifold metal terminal 100*b*. Further, the ground wires 100 for plug caps are electrically connected to the first ground wire 10 by clamping the manifold metal terminal 100*b* with the intake manifold metal terminal 10*d* via the bolt 4*a*.

In the figures, the reference symbol 8*b* stands for a positive electrode terminal of the battery 8, and 13 for a ground wire serving as vehicle minus wiring. The positive electrode terminal 8*b* is connected to the electric devices serving as an electric load. The ground wire 13 serving as the vehicle minus wiring is electrically connected together with the battery terminal 10*a* to the negative electrode terminal 8*a* by using a terminal extension tool (not shown in the figures). Further, the reference symbols 1*c* and 1*d* denote the holes for bolts drilled in the left and right strut towers 1*a*, 1*b*, and 7*a* denotes a bolt hole drilled in the body 7*b* of the throttle device 7.

The attachment of the first ground wire 10 and second ground wire 11 will be explained. As for the first ground wire 10, the battery metal terminal 10*a* is connected together with the vehicle ground wire 13 to the negative electrode terminal 8*a* of the battery 8 by using the terminal extension tool (not shown in the figure). The left strut metal terminal 10*f* is grounded together with the provided ground wire for a headlight (not shown in the figure) to the vehicle body by inserting the provided bolt into the bolt hole 1*c*. Similarly, the right strut metal terminal 11*a* of the second ground wire 11 is also grounded together with the ground wire (not shown in the figure) for the provided headlight to the vehicle body by screwing the provided bolt (not shown in the figure) into the bolt hole 1*d*.

Thus the engine ground system is formed by electrically connecting to the ground points provided at the engine 2 the intermediate positions on the first ground wire 10 in which the battery metal terminal 10*a* is clamped to the negative electrode terminal 8*a* and the strut metal terminal 10*f* is clamped to the left strut tower 1*a*. Thus, the cylinder head 2*a*, bolt 4*a* as a clamping member for the intake manifold, cylinder head cover 2*b*, and body 7*b* of the throttle device 7 are the ground points provided on the engine.

The throttle metal terminal 10*b* is thus connected to the throttle device 7 with the bolt screwed into the bolt hole 7*a* of the throttle body 7*b*.

The cylinder head metal terminal 10*c* is connected together with the provided ground wire (not shown in the figure) of the engine to the cylinder head 2*a* with the provided bolt (not shown in the figure).

The intake manifold metal terminal 10*d* is connected together with the manifold metal terminal 100*b* of the ground wire 100 for a plug cap to the intake manifold 4 by joint clamping with the bolt 4*a*.

The cylinder head cover metal terminal 10*e* is connected to the cylinder head cover 2*b* with bolts 20*b* (provided in an appropriate number of places around the cylinder head cover 2*b*) attaching the cylinder head cover 2*b* to the cylinder head 2*a*.

Further, the plug cap metal terminal 100*a* of the ground wire 100 for a plug cap is attached and connected to a bolt (not shown in the figure) for a plug cap serving to position and fix the plug cap 3 to the cylinder head 2*b*.

Therefore, in the embodiment having the above-described configuration, the first ground wire 10, ground wire 100 for a plug cap, and second ground wire 11 use the wire harness 12 having excellent electric conductivity and a low electric resistance, intermediate positions of the first ground wire 10 formed of this wire harness 12 are connected to ground points of the engine, and those ground points are electrically connected to the negative electrode terminal 8*a* of the battery 8 via the first ground wire 10. Therefore, during engine operation, the minus electric current generated on the negative electrode side of the spark plug smoothly flows directly to the negative electrode terminal 8*a* of the battery via the first ground wire 10, thereby improving engine performance. Thus, various effects are obtained including increase in torque in a low-speed and medium-speed range of the engine, increase in fuel efficiency, increase in start performance of the engine, improved purification of exhaust gases by complete combustion, increase in illumination degree of the headlamp, and noise reduction in audio equipment of various types.

The results of the performance tests conducted by the applicant will be described below in greater detail.

First, the performance evaluation test of spark plugs will be explained based on FIG. 4 and FIG. 5. The performance evaluation test of spark plugs was conducted with respect to a case where the first ground wire 10 was connected by setting the cylinder head 2*a* as the ground point of the engine at an intermediate position of the first ground wire 10, that is, with respect to a case where the cylinder head metal terminal 10*c* was electrically connected to the cylinder head 2*a* (such a case shall be referred to as "after the ground mounting") and a case where such a first ground wire 10 was not present (such a case shall be referred to as "before the ground mounting"). In this performance evaluation test of spark plugs, the primary electric current of the spark of the spark plug, power (PC), and torque (kg-m) before and after ground mounting were simultaneously measured and compared. In order to reproduce the state during vehicle movement, measurements were conducted with a load applied. As for the measurement conditions, in a speed mode reproducing the loaded state, a dynamo was used, the dynamo settings were such as to fix the engine rotation speed at 4000 rpm, the accelerator was completely opened, and the measurements were conducted with the speed set to 4000 rpm.

Figure 4:
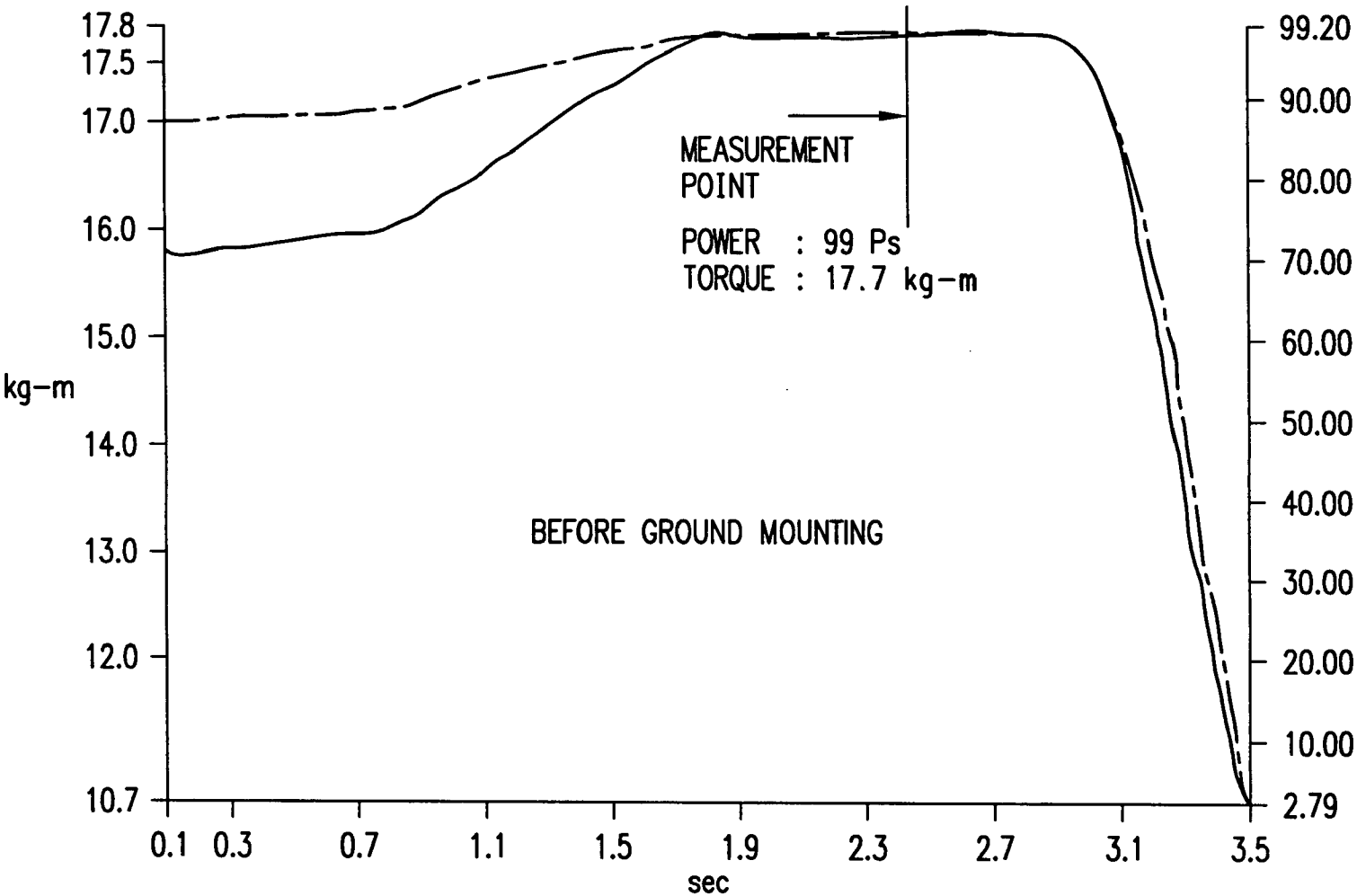
FIG. 4 is an output performance graph illustrating the relationship between power, torque, and time before the ground mounting.
Figure 5:
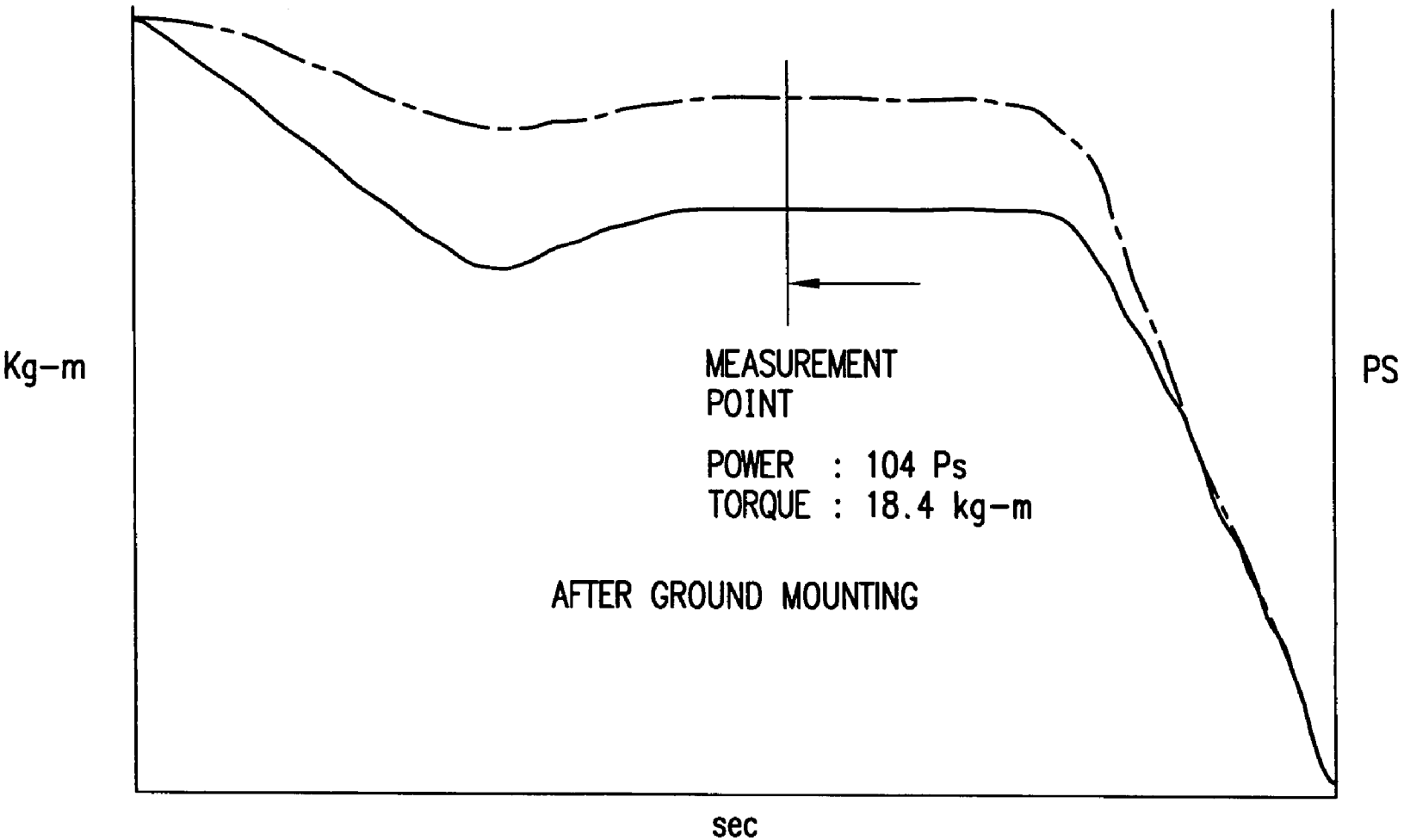
FIG. 5 is an output performance graph illustrating the relationship between power, torque, and time after the ground mounting.

As a result, as shown in FIG. 4, a performance graph illustrating the relationship between power, torque, and time before the ground mounting, and as shown in FIG. 5, the performance graph showing the relationship between power, torque, and time after the ground mounting were obtained. In each graph, the "measurement point" was the point in time in which the prescribed interval has elapsed since the rotation speed fluctuations have stabilized after the engine rotation speed had reached 4000 rpm. In FIG. 4 and FIG. 5, after the ground mounting, the power was found to increase by 104−99=5 (PS) and the torque was found to rise by 18.4−17.7=0.7 (kg-m) with respect to those before the ground mounting.

Figure 6:
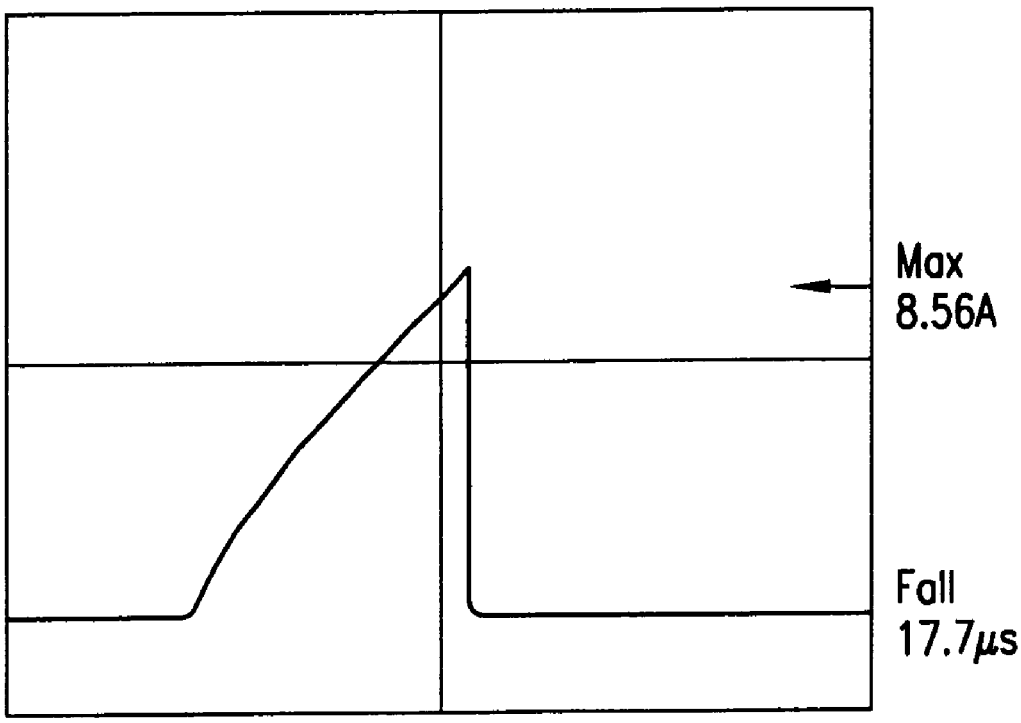
FIG. 6 is a graph illustrating the spark waveform obtained with an oscilloscope before the ground mounting.
Figure 7:
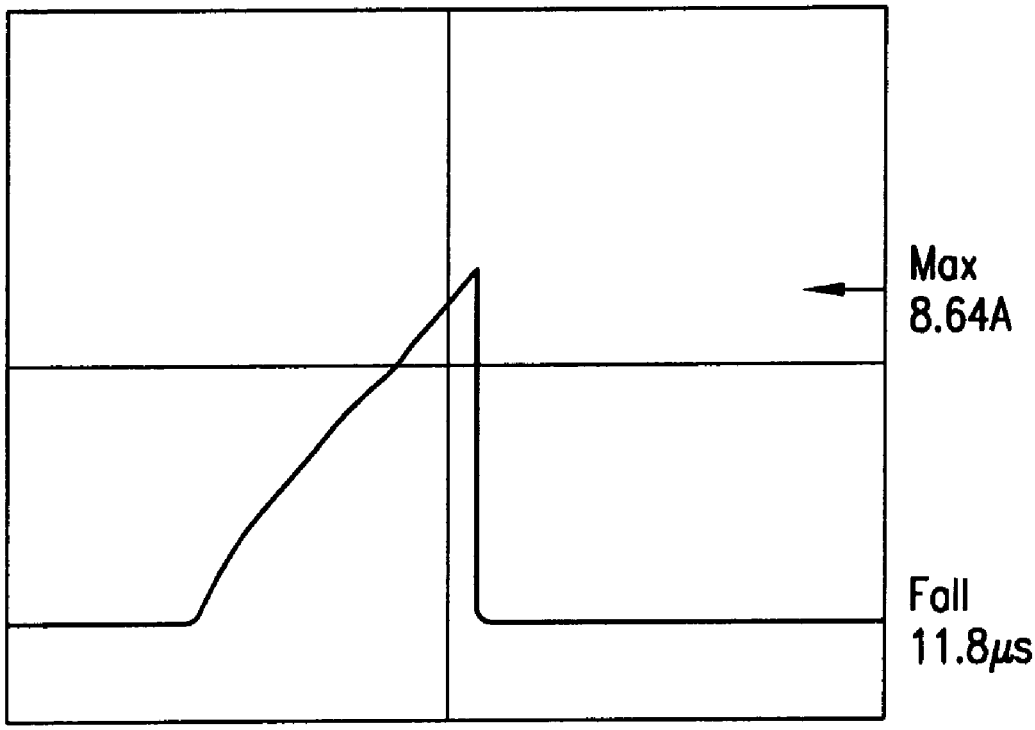
FIG. 7 is a graph illustrating the spark waveform obtained with an oscilloscope after the ground mounting.

Furthermore, FIG. 6 and FIG. 7 show the graphs representing the spark waveform obtained with an oscilloscope as the waveforms of the spark primary, current of the spark plug at this time. According to those graphs, the spark primary current increased by 8.64−8.56=0.08 (A) and it was found that the fall time (that is, the time until the output current drops to zero) was reduced by 17.7−11.8=5.9 (μs). Because the current value and time relate to the primary side, the electromotive force E induced on the secondary side by the mutual induction is represented by E=M(i/t). Here, M stands for mutual inductance, t stands for time, and i stands for electric current. Because the mutual inductance M does not change, from this formula, the electromotive force En in the case before the ground mounting becomes En=M(8.56 A/17.7 μs)=483615.8 M and the electromotive force Eh in the case after the ground mounting becomes Eh=M (8.64 A/11.8 μs)=73223.4 M. From here it follows that Eh=1.5 En. Therefore, it was clarified that with the engine ground system, after the ground mounting, an electromotive force has been generated that is about 1.5 times that of the usual state before the ground mounting. As follows from the comparison of data shown in FIG. 4 and FIG. 5, the power increased by 5 PS and the torque increased by 0.7 kg-m apparently because the generated electromotive force increased by a factor of 1.5.

Thus, employing the engine ground system of the present embodiment makes it possible to cause the minus current of the spark plug to flow smoothly to the negative electrode terminal 8*a* of the battery 8 via the first ground wire 10. As a result, the spark performance of the spark plug is greatly increased and, therefore, engine performance is improved.

Furthermore, various performance evaluation tests were conducted in addition to the above-described spark performance test. The results thereof will be described below. The below-described tests were conducted on vehicle A and vehicle B of different types, that is, having different weight and carrying different engines.

Figures 8A, 8B:
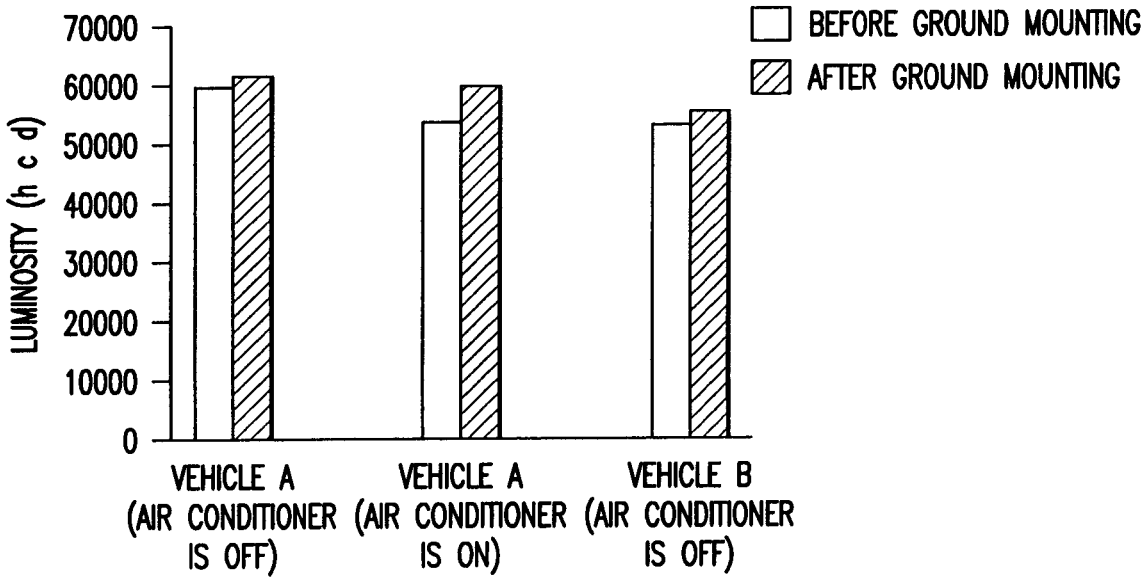
FIG. 8 represents data illustrating the luminosity measurement results, (a) is the data table, (b) is a graph illustrating how the data table is plotted as a graph.

The luminosity measurement results will be explained below based on FIG. 8. FIG. 8 shows the luminosity measurement results obtained by a bench test conducted by using a headlight test; figure (a) is a table showing the luminosity measurement data, (b) is a graph representing data described in the table. Those data demonstrated that the luminosity of the headlight after the ground mounting has increased over that before the ground mounting for both the vehicle A and the vehicle B. From this, it follows that the increase in luminosity is due to the fact that the ground wire for a headlight is connected at the strut towers 1*a*, 1*b* to the first ground wire 10 and second ground wire 11 formed in the wire hardness 12 with a four-layer structure having a core wire 12*a* with excellent electric conductivity as a center.

Figure 9:
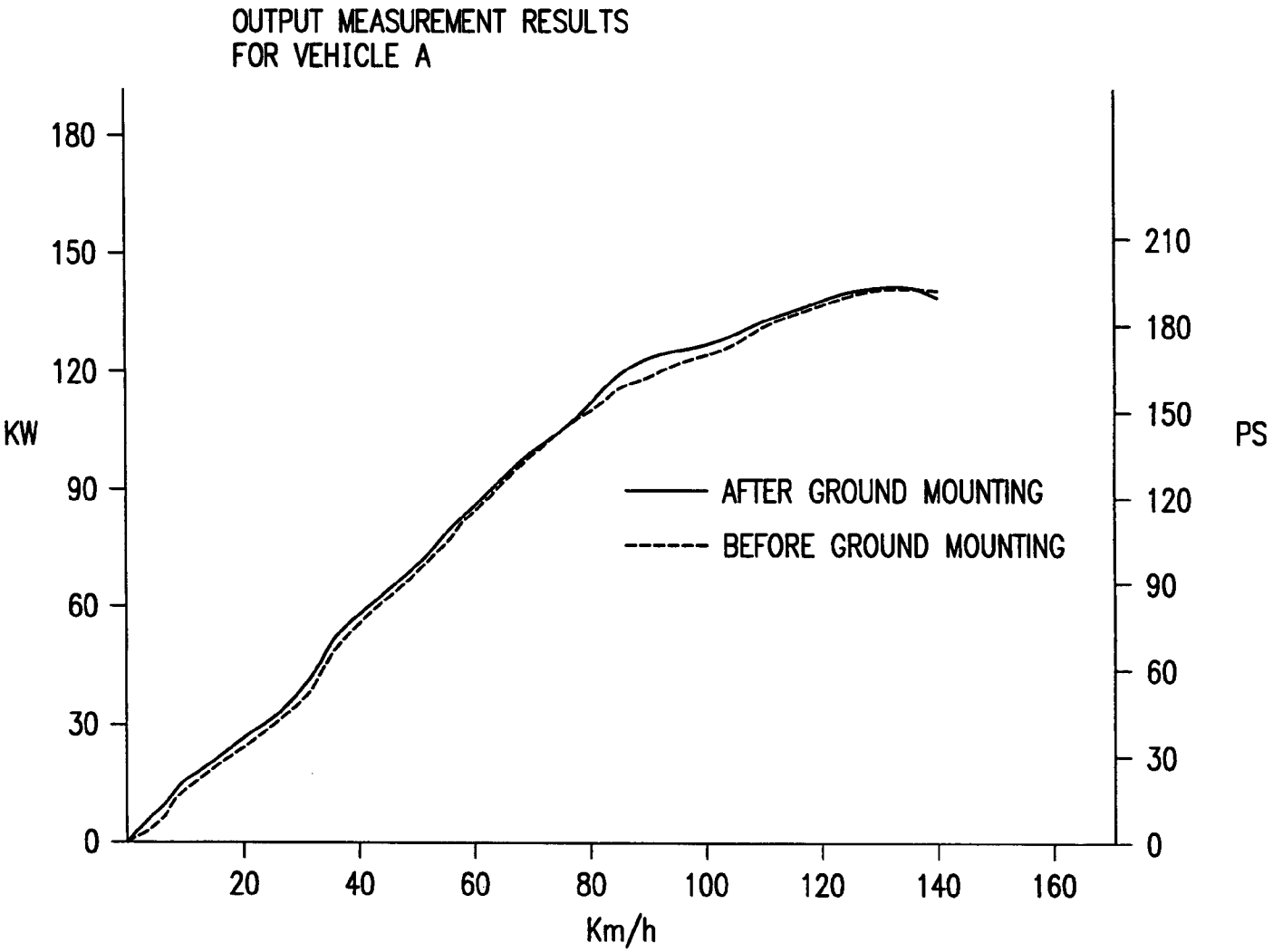
FIG. 9 is a graph representing the output measurement results showing the relationship between the output and speed of vehicle A.
Figure 10:
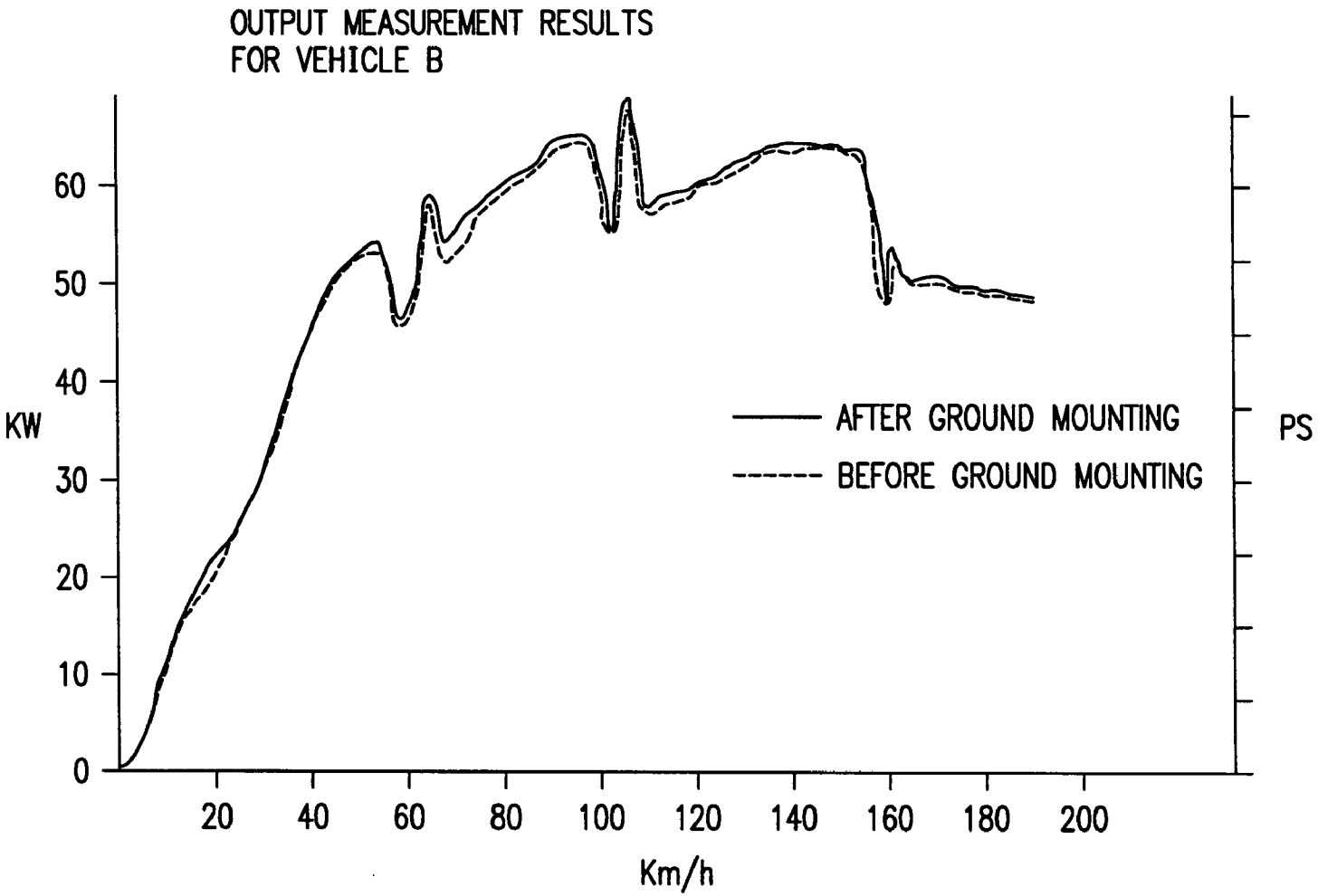
FIG. 10 is a graph representing the output measurement results for vehicle B, similarly to FIG. 9.

The output measurement results will be explained with reference to FIG. 9 and FIG. 10. FIG. 9 and FIG. 10 show the results obtained in measuring the engine output with a chassis dynamo tester. FIG. 9 is a graph showing output measurement results relating to vehicle A, and FIG. 10 is a graph showing output measurement results relating to vehicle B. In the case of vehicle A, the point in time with a speed of 180 km/h during maximum output generation was taken as the measurement point, and in the case of vehicle B, the point in time with a speed of 110 km/h during maximum output generation was taken as the measurement point. Results showed that in the vehicle A, the output after the ground mounting increased by 2.5% over that before the ground mounting, and in the case of vehicle B, the output also increased by 2.0%. Thus, it was found that employing the ground system resulted in a significant increase in engine output.

Figure 11:
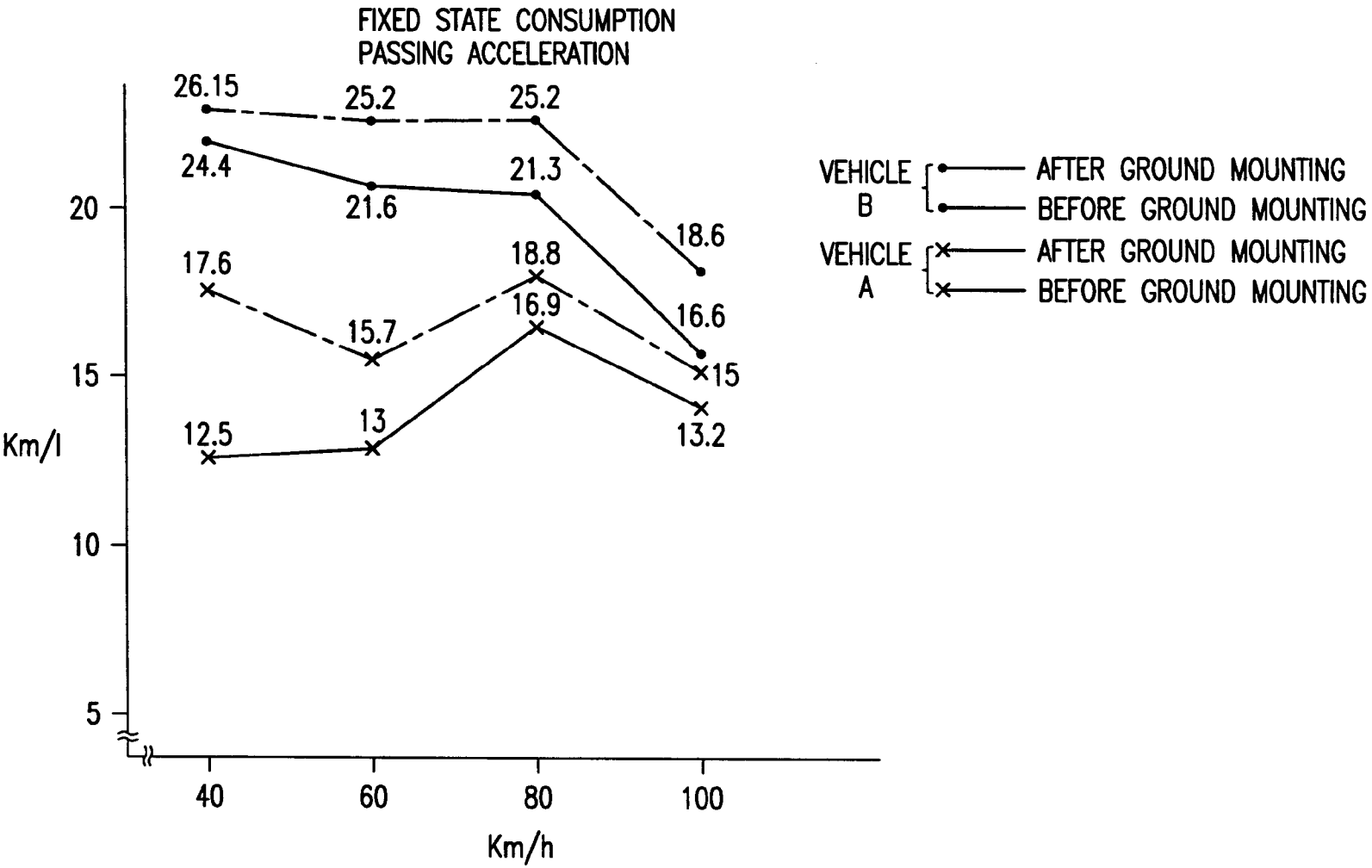
FIG. 11 is a fuel consumption at steady speed graph in which the test results on fuel consumption at steady speed are represented by the relationship between the fuel consumption and speed.

FIG. 11 illustrates measurement results relating to fuel consumption at steady speed determined by an actual vehicle running test. The fuel consumption at steady speed is determined by measuring the fuel consumption (km/L) when the vehicle runs at a constant speed from 40 km/h to 100 km/h, with intervals of 20 km/h in a test in which the vehicle runs at a constant speed on a horizontal straight road. As a result, as shown in FIG. 1, a fuel consumption at steady speed graph based on the fuel consumption at steady speed measurement data was obtained. A significant improvement of fuel consumption of 17.16% and 11.52% on average was obtained by employing the ground system in vehicle A and vehicle B, respectively. Thus, the ground system can improve fuel consumption.

Figure 12:
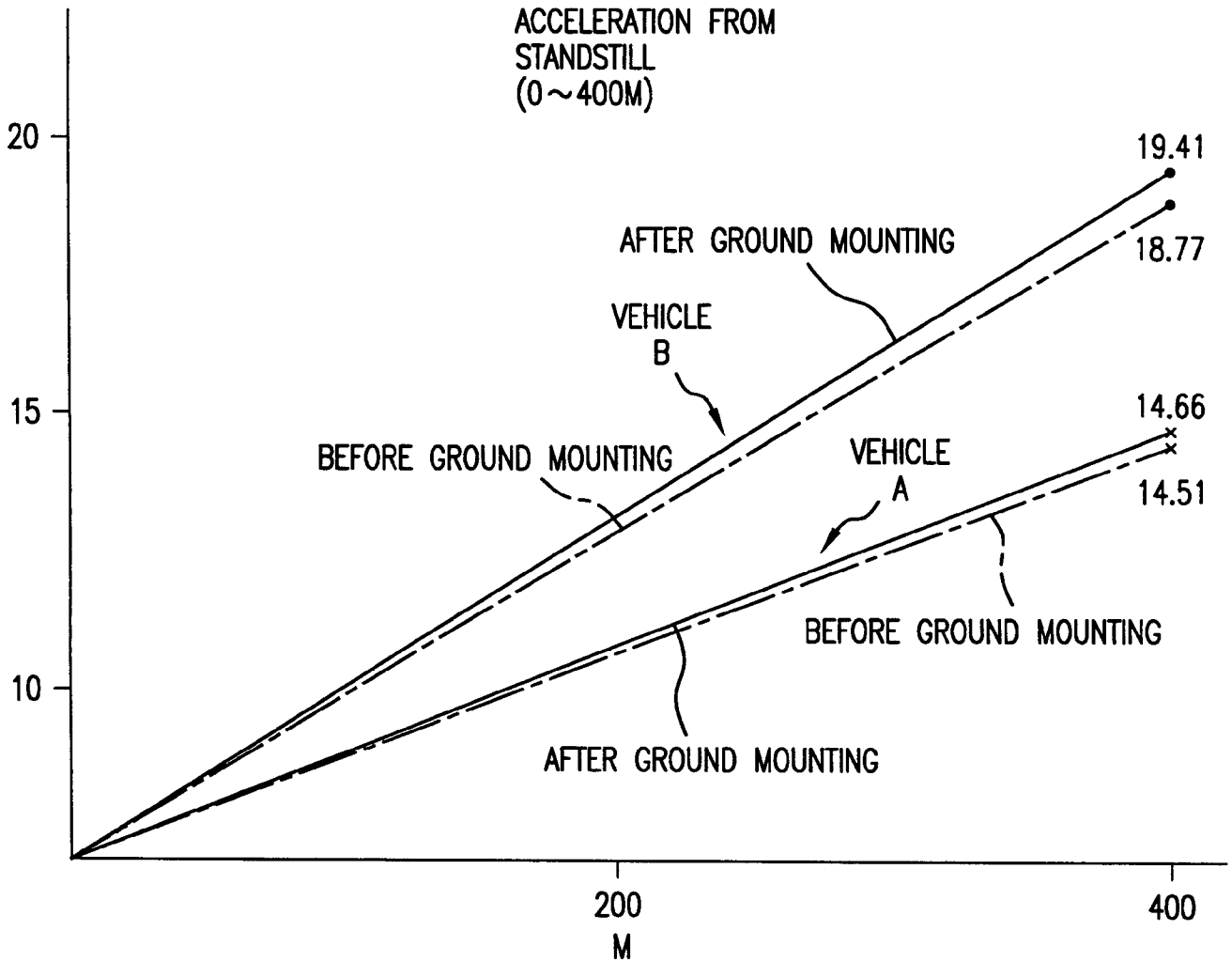
FIG. 12 is a start acceleration graph showing the results obtained in a start acceleration test.

FIG. 12 illustrates the measurement results relating to acceleration from standstill performance. The measurement conditions were as follows. A vehicle was running on a horizontal road and a contactless five-wheel measurement device was used to measure acceleration determined by time required for the vehicle to travel from 0 to 400 m. As a result, the acceleration from standstill graph shown in FIG. 12 was obtained. Thus, when the time required to reach 400 m was measured, it was found that employing the same ground system made it possible to shorten this time by 0.15 sec for vehicle A and by 0.64 sec for vehicle B with respect to the cases where no ground system was employed. Therefore, employing the ground system can increase the acceleration when the vehicle starts moving.

Figure 13:
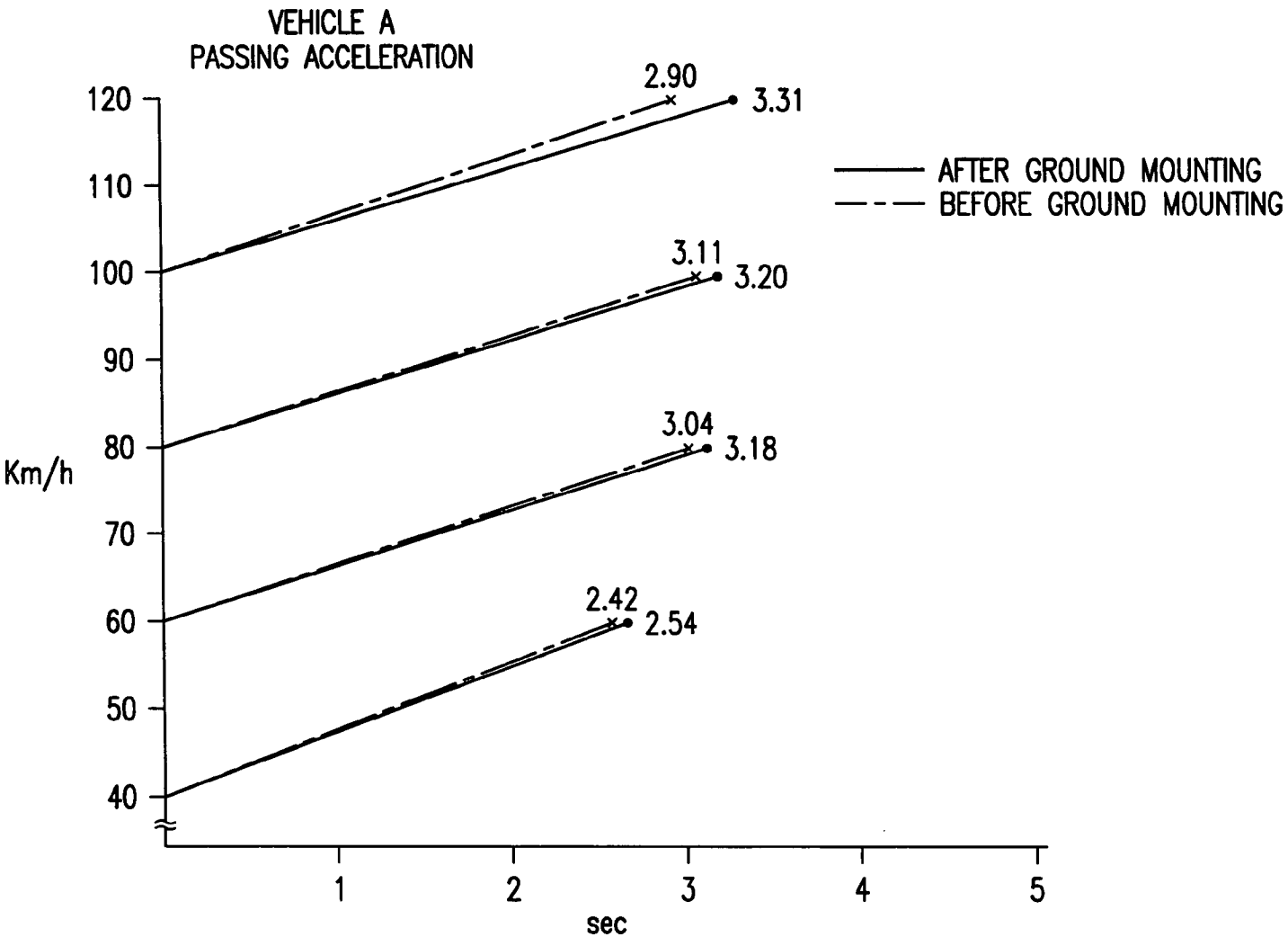
FIG. 13 is a graph showing the results of a passing acceleration test conducted on vehicle A.
Figure 14:
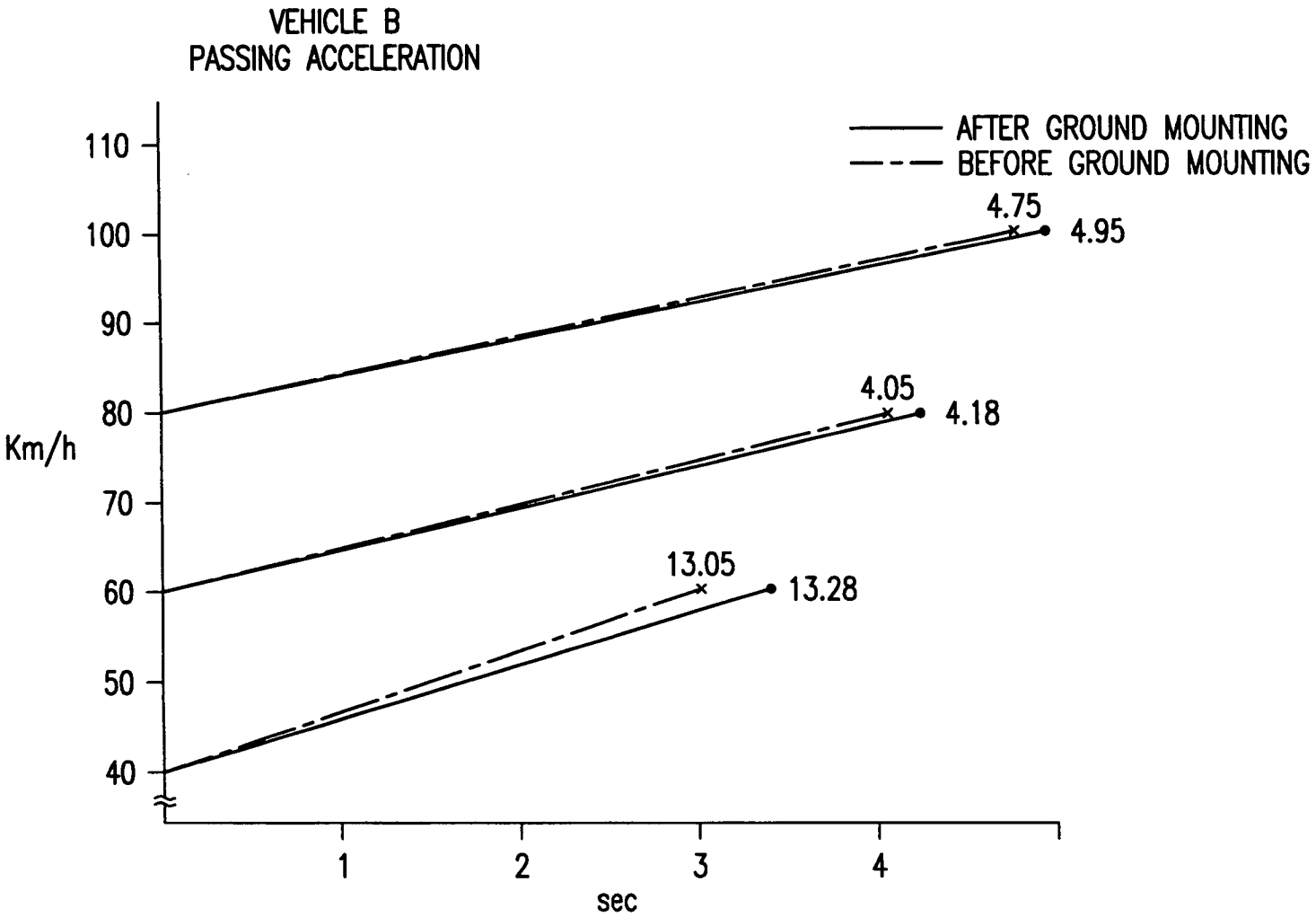
FIG. 14 is a graph showing the results of a passing acceleration test similarly conducted on vehicle B.

The measurement results relating to passing acceleration performance will be explained below with reference to FIG. 13 and FIG. 14. The results shown in FIG. 13 and FIG. 14 were obtained by measurements with a contactless five-wheel measurement device. The time required to increase the speed by 20 km/h from a standard speed, that is, from 40 km/h to 60 km/h and from 60 km/h to 80 km/h, was measured. FIG. 13 shows a passing acceleration graph relating to vehicle A, and FIG. 14 shows a passing acceleration graph relating to vehicle B. Both the vehicle A and the vehicle B could reach the prescribed speed within a shorter interval after the ground mounting then before the ground mounting. Therefore, excellent passing acceleration is demonstrated.

Figure 15:
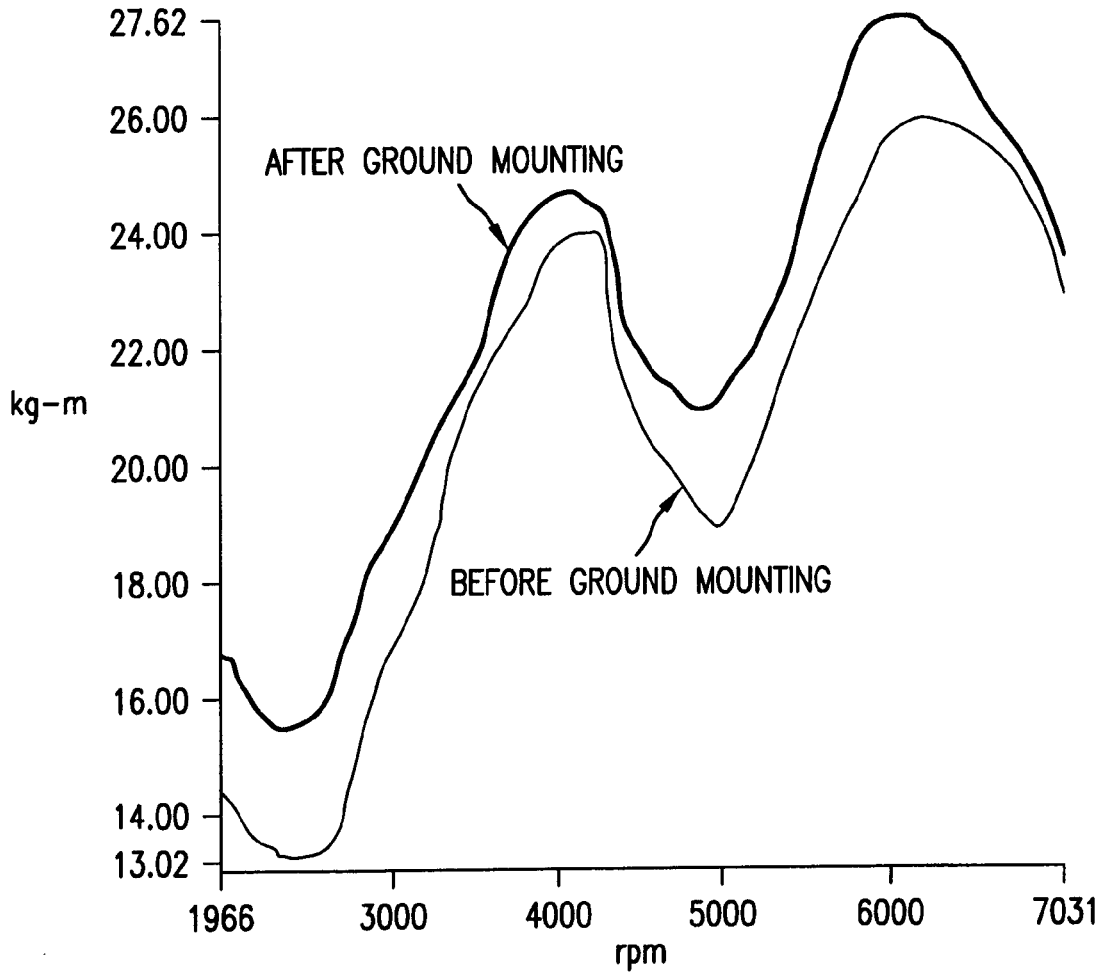
FIG. 15 relates to output measurement results obtained for vehicle C; this figure is a graph showing the relationship between torque and engine rpm.
Figure 16:
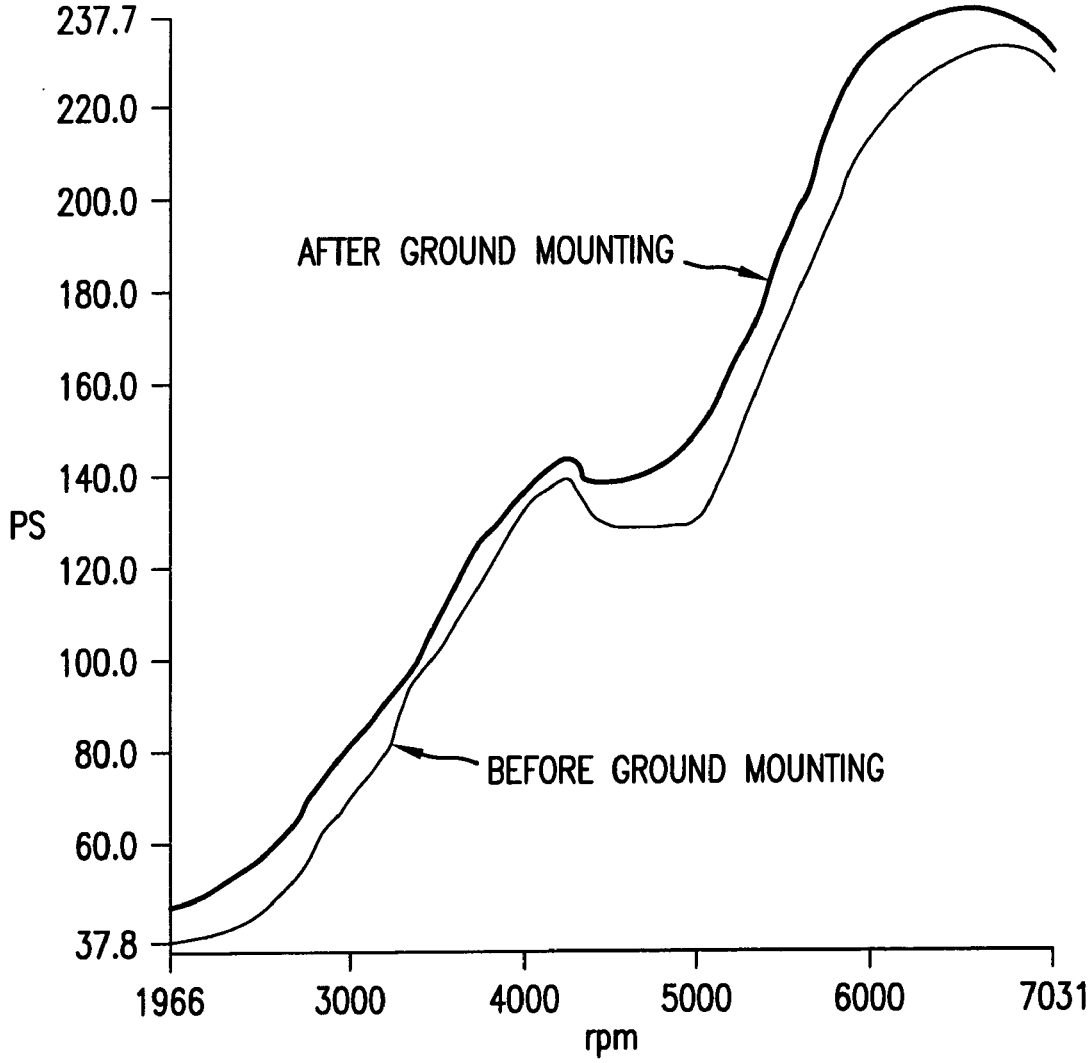
FIG. 16 relates to output measurement results obtained for vehicle C; this figure is a graph showing the relationship between output and engine rpm.

FIG. 15 and FIG. 16 show results relating to power performance obtained by conducting measurements with respect to a third vehicle (referred to hereinbelow as "vehicle C") that is different from the above-described vehicle A and vehicle B. FIG. 15 shows a rpm-torque diagram illustrating the relationship between the engine rpm and torque, and FIG. 16 shows a rpm-output diagram illustrating the relationship between the engine rpm and output (PS). A comparative test was conducted with respect to the case where a ground system shown in FIG. 1 was employed in a mode in which the ground wire 100 for a plug cap was not attached (such a case will be referred to as "after the ground mounting") and the case with a normal mode where such a ground system was not used at all (such a case will be referred to as "before the ground mounting"). Results show that, as shown in FIG. 15, in the entire rpm range of the engine, the torque was much higher when the ground system was employed (after the ground mounting) than when the ground system was not employed (before the ground mounting). Furthermore, FIG. 16 demonstrates that the start-end output after the ground mounting increased from before the ground mounting. Those results demonstrated that in vehicle C, too, the power performance improved due to the employment of the ground system.

Figure 17:
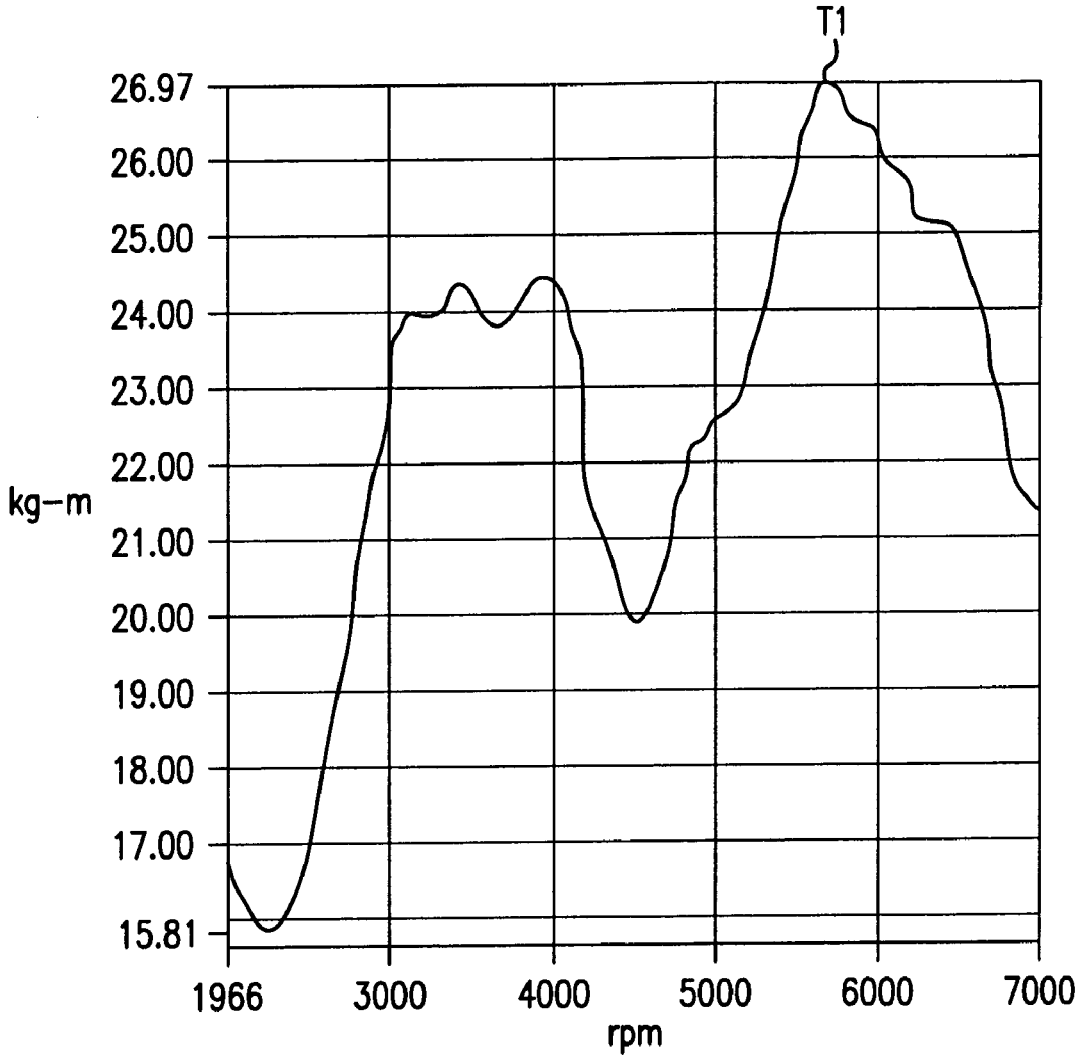
FIG. 17 relates to the results of a power performance test conducted without mounting the ground system on vehicle C and represents a graph showing the relationship between engine rpm and torque, where engine rpm is plotted against the abscissa and torque is plotted against the ordinate.
Figure 18:
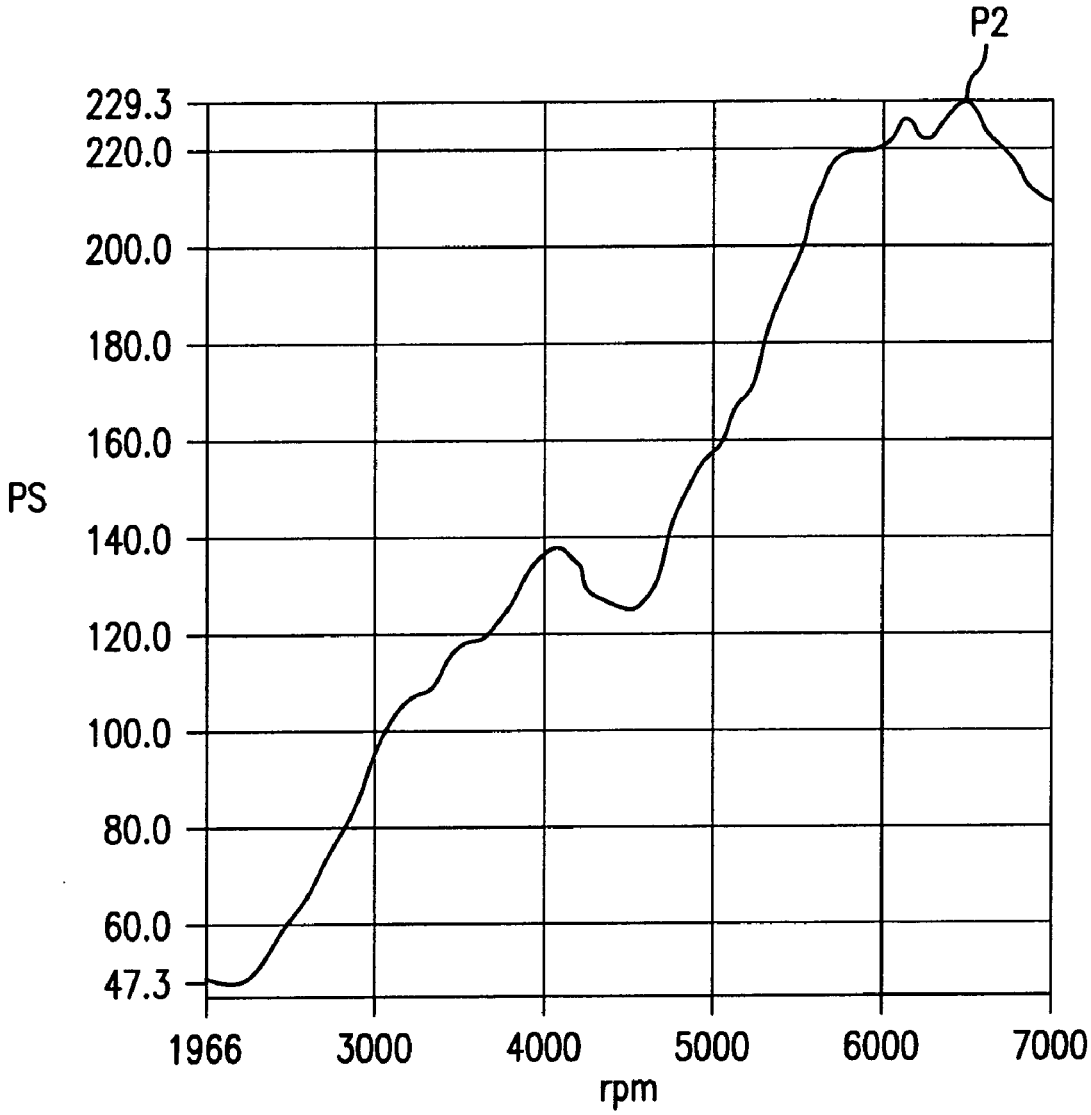
FIG. 18 relates to the results of a power performance test conducted without mounting the ground system on vehicle C and represents a graph showing the relationship between engine rpm and output, where engine rpm is plotted against the abscissa and output is plotted against the ordinate.
Figure 19:
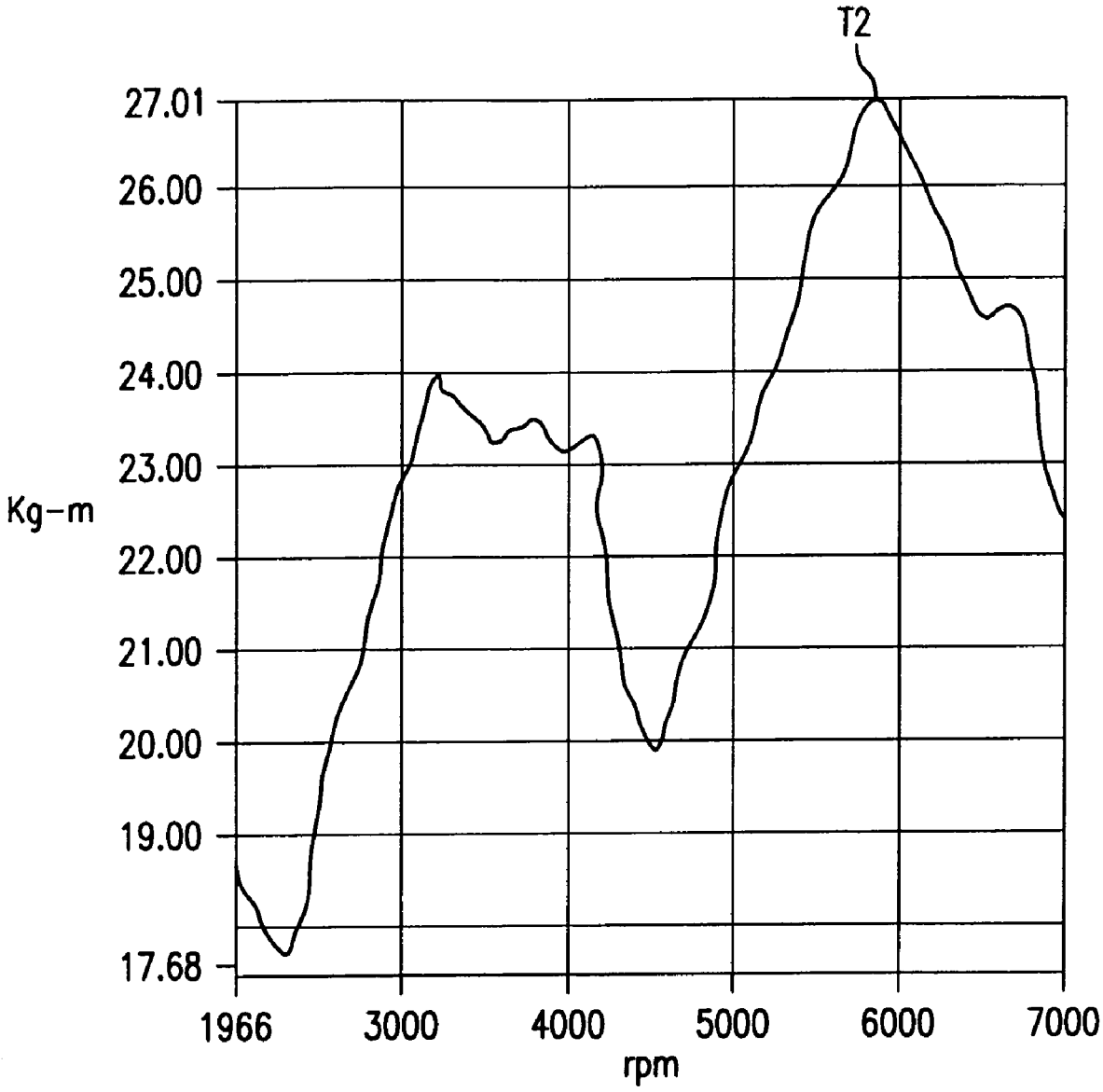
FIG. 19 relates to the results of a power performance test conducted on vehicle C with the mounted ground system, but in a mode in which no ground connection is made to the throttle body and represents a graph showing the relationship between engine rpm and torque, where engine rpm is plotted against the abscissa and torque is plotted against the ordinate.
Figure 20:
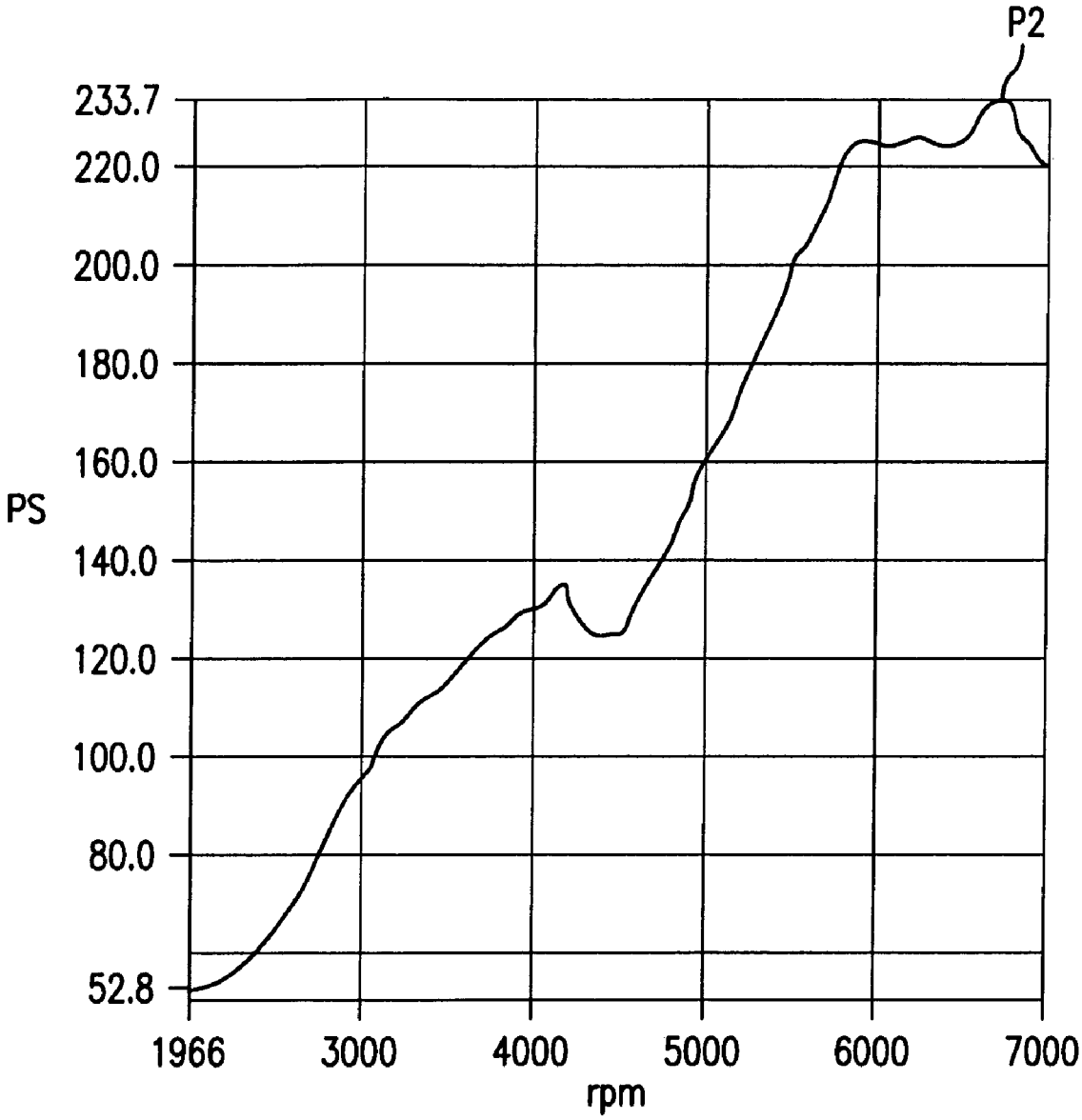
FIG. 20 relates to the results of a power performance test conducted on vehicle C with the mounted ground system, but in a mode in which no ground connection is made to the throttle body and represents a graph showing the relationship between engine rpm and output, where engine rpm is plotted against the abscissa and output is plotted against the ordinate.
Figure 21:
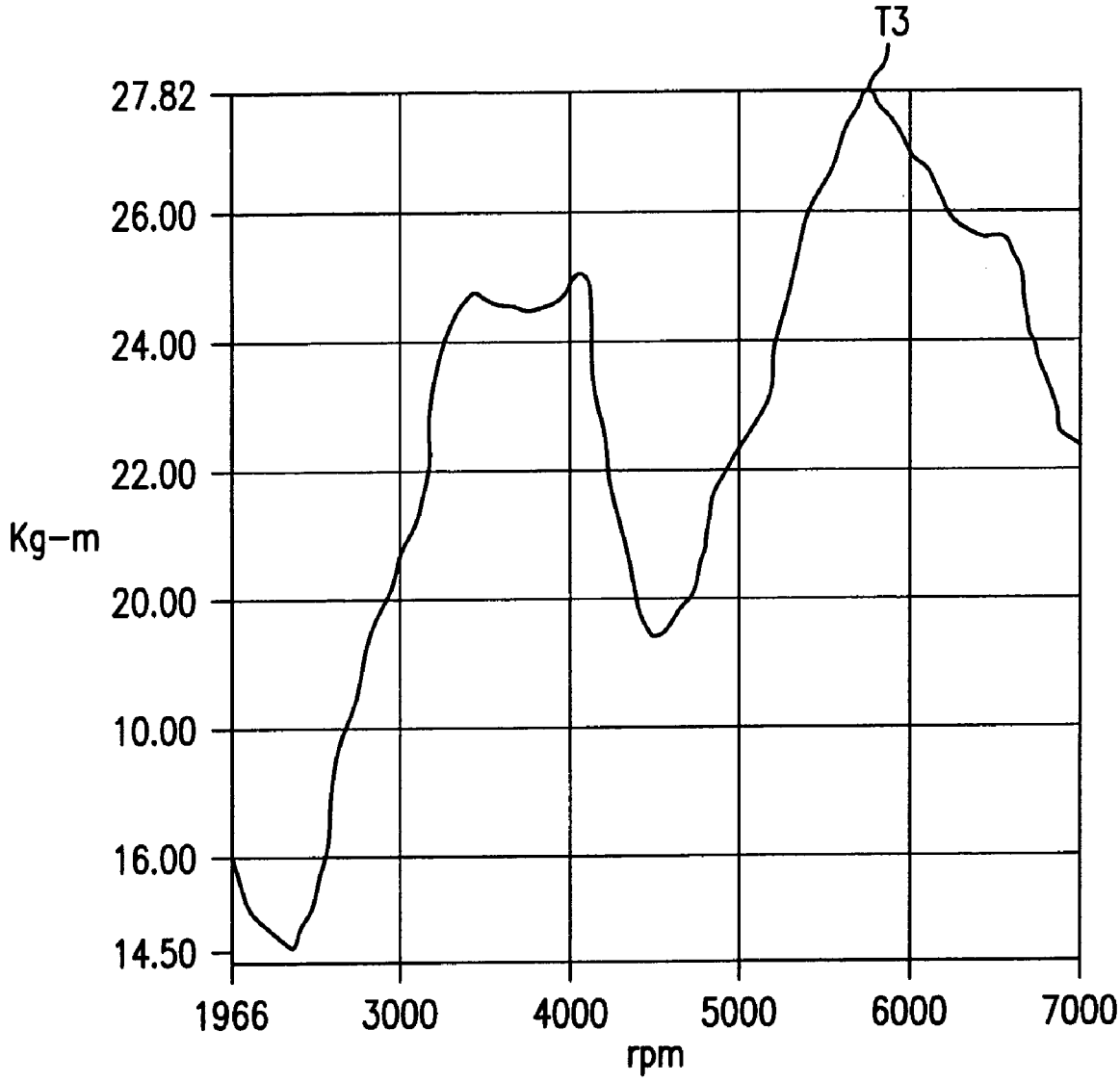
FIG. 21 relates to the results of a power performance test conducted on vehicle C in a ground system mode in which the throttle body was also grounded and represents a graph showing the relationship between engine rpm and torque, where engine rpm is plotted against the abscissa and torque is plotted against the ordinate.
Figure 22:
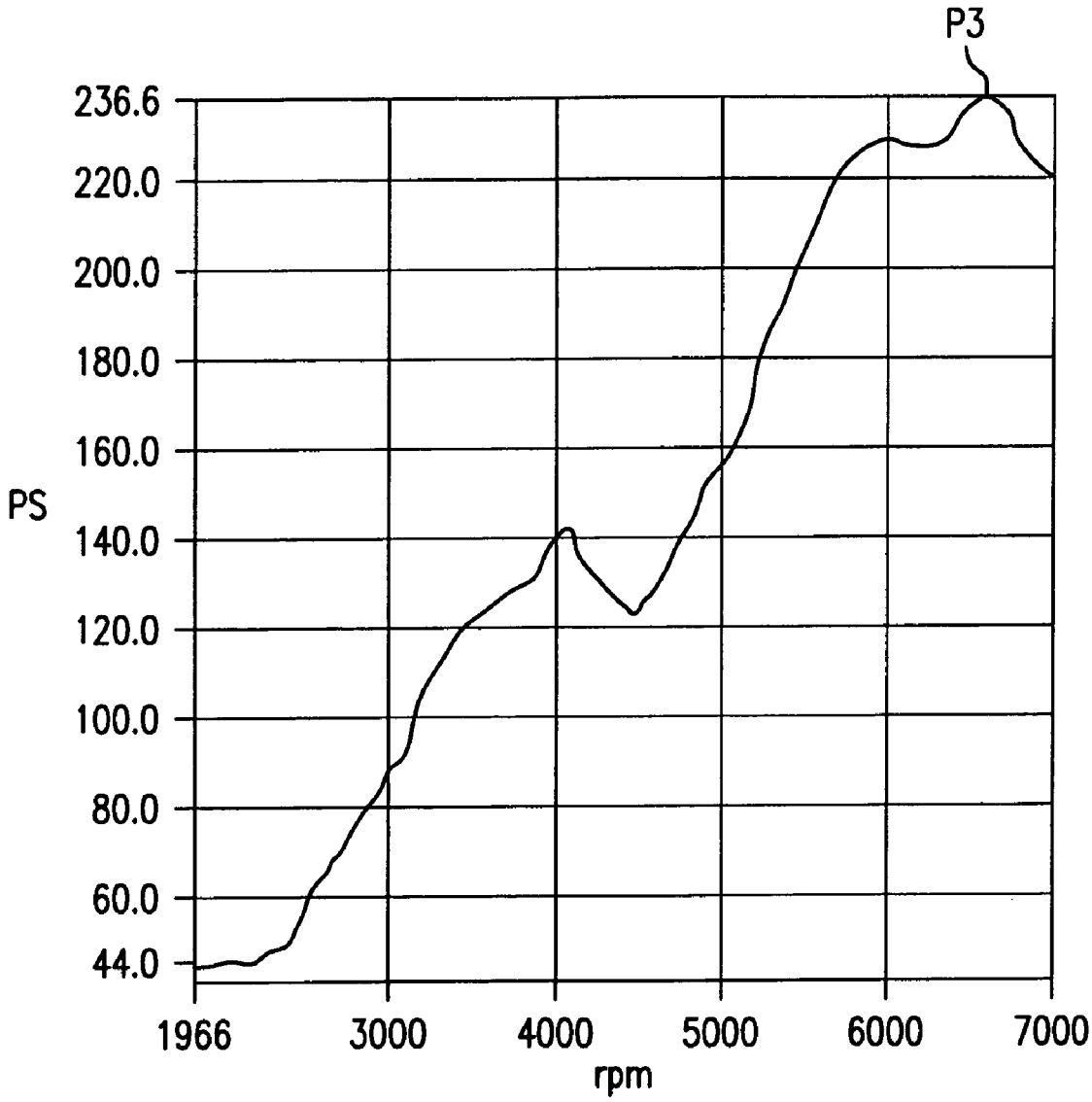
FIG. 22 relates to the results of a power performance test conducted on vehicle C in a ground system mode in which the throttle body was also grounded and represents a graph showing the relationship between engine rpm and output, where engine rpm is plotted against the abscissa and output is plotted against the ordinate.

The results of the power performance test shown in FIGS. 17 to 23 will be described. In the case of the vehicle C, the measurement conditions were such that the test was conducted with respect to the ground system in a mode in which the ground wire 100 for a plug cap was not attached. As for the measurement conditions in the test illustrated by FIGS. 17 to 23, as shown in FIG. 1, a ground system was employed in which the ground wire 100 for a plug cap was employed, but the performance comparison test was conducted separately for two sets of measurement conditions: with the ground system in a mode where the throttle metal terminal 10*b* was not connected to the throttle device 7 and the ground system in a mode where the throttle metal terminal 10*b* was connected. The test produced a graph representing the relationship between engine rpm and torque, in which engine rpm (rpm) was plotted against the abscissa and torque (kg-m) was plotted against the ordinate, as shown in FIG. 17, FIG. 19, and FIG. 21, and a power performance graph in which engine rpm was plotted against the abscissa and output was plotted against the ordinate, as shown in FIG. 18, FIG. 20, and FIG. 22. Further, FIG. 23 shows a table containing the maximum values represented in those FIGS. 17 to 22.

Thus, as shown in FIG. 17, when no ground system was mounted, the maximum value of torque was T1=26.97 (kg-m), and the maximum value of output was P1=229.3 (PS), as shown in FIG. 18. In a mode in which the ground system was mounted, but the ground was not connected to the throttle body 7*b*, the maximum torque value was T2=27.01 (kg-m) from FIG. 19 and the maximum output value was P2=233.7 (PS) from FIG. 20. Furthermore, in the case of the ground system shown in FIG. 1, that is, the ground system in which the throttle body 7*b* was also grounded, the following measurement results were obtained: the maximum torque value T3=27.82 (kg-m), as follows from FIG. 21, and the maximum output value P3=236.6 (PS), as follows from FIG. 22.

As follows from the table shown in FIG. 23, which represents the above-described values of the maximum torque and maximum output, the maximum torque values (T2, T3) and maximum output values (P2, P3) obtained when the engine was driven in a mode with the mounted ground system were higher than the maximum torque value T1 and maximum output value P1 obtained when the engine was driven in a mode without the mounted ground system. Therefore, the power performance of the engine with the mounted ground system was found to be improved. Further, even when the ground system was mounted, the maximum torque value T3 and maximum output value P3 obtained with grounding were larger than the maximum torque value T2 and maximum output value P2 obtained when the throttle body was not grounded. Accordingly it was decided that the engine with the ground system which grounds the throttle body 7*b* is superior in terms of power performance.

In the above-described embodiment, the ground points on the engine side were the cylinder head 2*a*, clamping member (bolt 4*a*) for the intake manifolds, cylinder head cover 2*b*, and body 7*b* of the throttle device 7. In addition, for example, the transmission or surge tank provided in the intake system may be set as a ground point, and an increase in the number of ground points is advantageous in terms of spark performance of the spark plugs.

Further, in the above-described embodiment, the explanation was conducted with respect to a case where a direct ignition coil was used, but it goes without saying that the application to a so-called mechanical spark system using a distributor or the like is also possible.

Furthermore, in the above-described embodiment, the explanation was conducted with respect to an automobile, but the present invention can be also applied to a variety of engines used in outboard motors, bicycles, carts, snowmobiles, and the like.

The inventions with the above-described configuration demonstrate the below-described effect. The invention provides an engine ground system in which intermediate positions on a ground wire electrically connected by one end thereof to a negative electrode terminal of a battery are electrically connected to ground points of the engine and then the other end of said ground wire is grounded to the vehicle body, wherein the ground point of the engine is the cylinder head of the engine. Therefore, the following effects are produced: the torque in the low-speed and medium-speed range of the engine is increased, the fuel consumption is improved, performance of various types such as the spark performance, initial performance of the engine, acceleration from standstill performance of the engine, and passing acceleration of performance is improved, exhaust gas is purified by complete combustion, the degree of illumination with the head lamp is increased, and noise level of various audio devices is reduced.

According to another aspect the invention, the clamping member for the intake manifold is added as the ground point. Therefore, the minus current of the spark plug also flows from the clamping member for the intake manifold to the negative electrode terminal of the battery via the ground wire and spark characteristics are further improved.

According to another aspect of the invention, the cylinder head cover is added as a ground point. Therefore, in addition, the minus current of the spark plug also flows from the cylinder head cover, thereby accordingly improving the accuracy of ground tuning.

According to another aspect of the invention, the throttle body is added as a ground point. Therefore, static electricity generated on the throttle body can be eliminated. As a result, the minus electric current of the spark plugs can flow smoothly to the negative electrode terminal of the battery, the spark performance of the spark plugs is further improved, the hindrance of acoustic devices by noise induced by static electricity can be avoided, and the performance of acoustic devices can be maintained in a good state.

According to another aspect of the invention, spark means provided in the engine has a direct ignition coil of an internal igniter type and the other end of the ground wire for a plug cap electrically connected by one end thereof to the plug cap accommodating the direct ignition coil is electrically connected to the clamping member for an intake manifold. As a result, the ground wire for the plug cap is provided so as to connect the plug cap accommodating the direct injection coil and the clamping member for the intake manifold, the minus electric current of the spark plug flows directly from the plug cap to the ground wire for the plug cap, the electric resistance toward the negative electrode terminal of the battery is accordingly decreased, and the spark performance of the spark plug is improved.

According to another aspect of the invention, one end portion of the ground wire for a plug cap is connected to the clamping member for the plug cap. Therefore, connecting one end portion of the ground wire for a plug cap to the clamping member for the plug cap, which is screwed into the cylinder head of the engine, allows the minus current of the spark plug to flow to the ground wire for the plug cap with higher reliability.

According to another aspect of the invention, a separate ground wire connected to the negative electrode terminal of the battery is grounded to the vehicle body. Therefore, luminosity of lamps such as headlights is increased.

According to another aspect of the invention, the ground wire and the ground wire for a plug cap have a four-layer structure comprising, from the core portion thereof, a core wire composed of bundled twisted wires formed by twisting fine copper wires, an inner coating member, which is a synthetic resin material coated on the outer periphery of the core wire, a wire mesh, which is an electrically conductive material provided so as to cover the outer periphery of said coating material, and an outer coating member, which is a synthetic resin material, provided on the outer periphery of the wire mesh. Therefore, the core wire of the ground wire or ground wire for the plug cap, which has a four-layer structure, demonstrates an ultra-low resistance. As a result, the minus current generated in the spark plug can flow smoothly to the negative electrode terminal of the battery. Furthermore, because the core wire is covered with the wire mesh, electromagnetic waves emitted from the engine compartment to the outside environment can be reliability shielded, and noise generated in the electronic control equipment for engine and hindrance such as noise in the audio equipment can be effectively avoided.

The invention claimed is:

1. A ground system for an engine mounted in a vehicle body, comprising a ground wire having two ends, the ground wire being electrically connected by one of said ends thereof to a negative electrode terminal of a battery,intermediate positions on the ground wire being electrically connected to ground points of the engine and the other end of said ground wire being grounded to the vehicle body, the ground points of the engine comprising a ground point on a cylinder head of said engine.

2. A ground system according to claim 1, wherein the ground points of said engine further comprise a clamping member for an intake manifold for clamping the intake manifold to the cylinder head.

3. A ground system according to claim 2, wherein the ground points of said engine further comprise a cover of the cylinder head.

4. A ground system according to claim 3, wherein the ground points of said engine further comprise a throttle body.

5. The engine ground system according to any of claims 2 through 4, wherein spark means provided in said engine has a direct ignition coil of an internal igniter type accommodated in a plug cap, a ground wire for the plug cap, one end of the plug cap ground wire being electrically connected to the plug cap and the other end of the plug cap ground wire being electrically connected to said clamping member for an intake manifold.

6. The engine ground system according to claim 5, wherein one end of said plug cap of said ground wire is electrically connected to a clamping member for clamping said plug cap to said cylinder head.

7. The engine ground system according to any of claims 1 through 4, wherein the negative electrode terminal of said battery to which the other end portion of said ground wire is electrically connected is grounded to said vehicle body via another ground wire different from said ground wire.

8. The engine ground system according to claim 5, wherein said ground wire and said ground wire for a plug cap each have a four-layer structure comprising a core wire comprised of bundled twisted wires formed by twisting fine copper wires, an inner coating comprising a synthetic resin material coated on an outer periphery of the core wire, a wire mesh comprising an electrically conductive material and covering an outer periphery of said coating material, and an outer coating comprising a synthetic resin material on an outer periphery of said wire mesh.

9. The engine ground system according to claim 6, wherein said ground wire and said ground wire for a plug cap each have a four-layer structure comprising a core wire comprised of bundled twisted wires formed by twisting fine copper wires, an inner coating comprising a synthetic resin material coated on an outer periphery of the core wire, a wire mesh comprising an electrically conductive material and covering an outer periphery of said coating material, and an outer coating comprising a synthetic resin material on an outer periphery of said wire mesh.

* * * * *